US011308916B2

(12) United States Patent
Otoi

(10) Patent No.: US 11,308,916 B2
(45) Date of Patent: Apr. 19, 2022

(54) LUMINANCE DETERMINING METHOD, LUMINANCE DETERMINING DEVICE, AND VIDEO DISPLAY APPARATUS

(71) Applicant: SOCIONEXT INC., Kanagawa (JP)

(72) Inventor: Katsuya Otoi, Yokohama (JP)

(73) Assignee: SOCIONEXT INC., Kanagawa (JP)

( * ) Notice: Subject to any disclaimer, the term of this patent is extended or adjusted under 35 U.S.C. 154(b) by 0 days.

(21) Appl. No.: 17/124,111

(22) Filed: Dec. 16, 2020

(65) Prior Publication Data

US 2021/0104210 A1 Apr. 8, 2021

Related U.S. Application Data

(63) Continuation of application No. PCT/JP2018/023367, filed on Jun. 19, 2018.

(51) Int. Cl.
*G09G 5/10* (2006.01)
*G09G 3/3208* (2016.01)

(52) U.S. Cl.
CPC ..... *G09G 5/10* (2013.01); *G09G 3/3208* (2013.01); *G09G 2320/045* (2013.01); *G09G 2320/046* (2013.01); *G09G 2320/0686* (2013.01)

(58) Field of Classification Search
CPC .. G09G 5/10; G09G 3/3208; G09G 2320/045; G09G 2320/046; G09G 2320/0686; G09G 2320/066; G09G 2360/16; G09G 2320/0271
See application file for complete search history.

(56) References Cited

U.S. PATENT DOCUMENTS

| | | | | |
|---|---|---|---|---|
| 6,791,566 | B1 | 9/2004 | Kuratomi et al. | |
| 9,858,850 | B2 * | 1/2018 | Lin | G09G 3/2007 |
| 10,210,604 | B2 * | 2/2019 | Jin | G06T 5/007 |
| 10,388,231 | B2 * | 8/2019 | Zhou | G09G 3/3406 |
| 10,504,456 | B2 * | 12/2019 | Inokawa | G09G 3/3225 |
| 2008/0036872 | A1 * | 2/2008 | Nobori | G06T 5/40 348/222.1 |
| 2009/0267926 | A1 * | 10/2009 | Seo | G09G 3/3426 345/204 |
| 2011/0279732 | A1 | 11/2011 | Kanda | |

(Continued)

FOREIGN PATENT DOCUMENTS

| | | | |
|---|---|---|---|
| JP | 2002-055675 | A | 2/2002 |
| JP | 2011-237690 | A | 11/2011 |

(Continued)

OTHER PUBLICATIONS

International Search Report and Written Opinion dated Sep. 18, 2018 in International Application No. PCT/JP2018/023367; with English translation.

*Primary Examiner* — Rodney Amadiz
(74) *Attorney, Agent, or Firm* — McDermott Will & Emery LLP

(57) ABSTRACT

A luminance determining method of determining a luminance of each pixel in a display device that includes a self emitting element includes dividing one image into a plurality of blocks that do no overlap each other; and correcting, in each of the plurality of blocks, a luminance of each pixel by reducing the luminance in the plurality of blocks through a correction method determined for each of the plurality of blocks.

17 Claims, 18 Drawing Sheets

(56) References Cited

U.S. PATENT DOCUMENTS

| | | | | |
|---|---|---|---|---|
| 2012/0147067 | A1* | 6/2012 | Hashimoto | G09G 3/3611 345/690 |
| 2012/0154459 | A1* | 6/2012 | Otoi | G09G 3/3426 345/690 |
| 2012/0176419 | A1* | 7/2012 | Otoi | H04N 5/57 345/690 |
| 2013/0314454 | A1* | 11/2013 | Jin | G09G 3/30 345/690 |
| 2014/0225943 | A1* | 8/2014 | Shiobara | G09G 3/3607 345/694 |
| 2017/0061595 | A1* | 3/2017 | Suzuki | G06T 5/40 |
| 2017/0116902 | A1 | 4/2017 | Kuo et al. | |
| 2020/0160492 | A1* | 5/2020 | Liu | G09G 5/10 |
| 2021/0312589 | A1* | 10/2021 | Moriuchi | G06T 5/009 |

FOREIGN PATENT DOCUMENTS

| | | | |
|---|---|---|---|
| JP | 2011-242690 | A | 12/2011 |
| JP | 2016-099419 | A | 5/2016 |
| JP | 2017-111345 | A | 6/2017 |

* cited by examiner

LUMINANCE DETERMINING METHOD, LUMINANCE DETERMINING DEVICE, AND VIDEO DISPLAY APPARATUS

CROSS REFERENCE TO RELATED APPLICATION

This is a continuation application of PCT Patent Application No. PCT/JP2018/023367 filed on Jun. 19, 2018, designating the United States of America. The entire disclosure of the above-identified application, including the specification, drawings and claims is incorporated herein by reference in its entirety.

FIELD

The present disclosure relates to a luminance determining method and a luminance determining device for a display device that includes a self emitting element and relates to a video display apparatus that includes the luminance determining device.

BACKGROUND

An organic electroluminescence (EL) display is known as a display device that includes a self emitting element, such as an organic EL element (organic light emitting diode (OLED)). In some ongoing studies, the lifetime of the pixels in an organic EL display may be extended by reducing the power consumption. For example, Patent Literature 1 discloses an application of a luminance gradient based on the fact that a person tends to focus on a center portion of a screen when he or she looks at the screen. In this luminance gradient, the output grayscale level is lowered from the center of the screen toward its peripheral portion.

CITATION LIST

Patent Literature

PTL 1: Japanese Unexamined Patent Application Publication No. 2002-55675

SUMMARY

Technical Problem however, the method disclosed in Patent Literature 1 does not take the displayed image into consideration. Therefore, the gradient in the luminance itself can be noticed by the viewer, depending on the displayed image.

Accordingly, the present disclosure provides a luminance determining method, a luminance determining device, and a video display apparatus that are visually less noticeable to a viewer and that can extend the lifetime of a display device.

Solution to Problem

A luminance determining method according to one aspect of the present disclosure is a method of determining a luminance of each pixel in a display device that includes a self emitting element, and the luminance determining method includes: dividing one image into a plurality of blocks that do not overlap each other; and correcting, in each of the plurality of blocks, a luminance of each pixel by reducing the luminance in the plurality of blocks through a correction method determined for each of the plurality of blocks.

It is to be noted that general or specific embodiments of the above may be implemented in the form of a system, a method, an integrated circuit, a computer program, or a computer-readable recording medium, such as a CD-ROM, or may be implemented in the form of any desired combination of a system, a method, an integrated circuit, a computer program, and a recording medium.

Advantageous Effects

The luminance determining method according to one aspect of the present disclosure and so on can extend the lifetime of a display device while being visually less noticeable.

BRIEF DESCRIPTION OF DRAWINGS

These and other advantages and features will become apparent from the following description thereof taken in conjunction with the accompanying Drawings, by way of non-limiting examples of embodiments disclosed herein.

DESCRIPTION OF EMBODIMENTS

Figure 1:
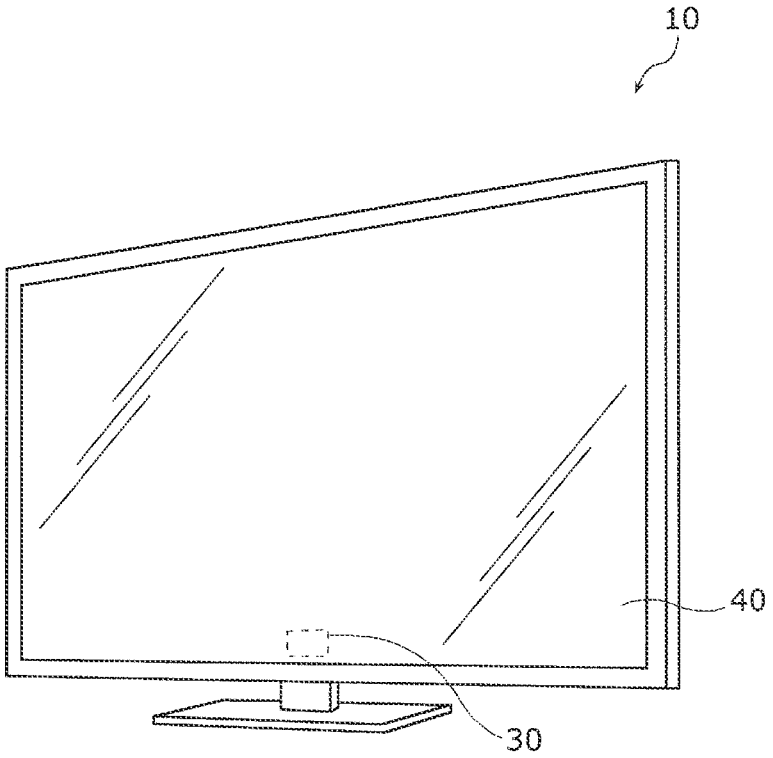
FIG. 1 illustrates an outer appearance of a video display apparatus according to Embodiment 1.

A luminance determining method according to one aspect of the present disclosure is a luminance determining method of determining a luminance of each pixel in a display device that includes a self emitting element, and the luminance determining method includes dividing one image into a plurality of blocks that do no overlap each other and correcting, in each of the plurality of blocks, a luminance of each pixel by reducing the luminance in the plurality of blocks through a correction method determined for each of the plurality of blocks.

According to the above, the luminance can be corrected and reduced in each block through the correction method determined for each block. Therefore, the luminance can be corrected more finely as compared to the case where the luminance is corrected based on a luminance gradient or the luminance is corrected uniformly in an entire screen. Accordingly, the luminance determining method according to one aspect of the present disclosure is less noticeable to a viewer and can extend the lifetime of the display device.

For example, the correction method reduces, in each of the plurality of blocks, a luminance of each pixel in one block among the plurality of blocks by a smaller amount as a level of a bright luminance is higher relative to a first representative luminance. The first representative luminance is a luminance of a pixel within the one block, and the bright luminance is a luminance of another pixel having a luminance higher than the first representative luminance.

According to the above, the luminance of a pixel having a bright luminance is reduced by a smaller amount than the luminance of a pixel having a luminance darker than the luminance of the pixel having the bright luminance. In other words, the luminance of a pixel having a high luminance originally is retained at the high level even after the luminance correction. Accordingly, the brightness is retained visually even in an image obtained after the luminance correction, and thus the correction is less noticeable to the viewer.

For example, when a luminance of each pixel input in the correcting is defined as a first luminance, a luminance of each pixel subjected to a luminance correction in the correcting is defined as a second luminance, the first representative luminance is defined as a mean value of the first luminance of each pixel in the one block, and the bright luminance is defined as a maximum value of the first luminance of each pixel in the one block, the correction method corrects, in each of the plurality of blocks, the first luminance of each pixel to the second luminance based on the mean value in the one block among the plurality of blocks and the maximum value in the one block.

According to the above, the luminance of each pixel in a given block can be corrected based on the mean value and the maximum value of the luminances of the pixels in the given block. For example, the correction can be made in consideration of a case where there is a prominently bright portion (pixels) in a generally dark environment.

For example, the correction method corrects the first luminance of each pixel to the second luminance based on a difference between the mean value and the maximum value. For example, the correction method corrects the first luminance to reduce a luminance difference between the first luminance and the second luminance more as the difference between the mean value and the maximum value is greater.

According to the above, the luminance of each pixel included in one block can be corrected based on the luminance difference between the mean value and the maximum value of the luminances. For example, the luminance is corrected such that the amount of darkening in the luminance of each pixel included in one block is smaller when the luminance difference is large. In other words, when there is a prominently bright pixel in a given block, the luminance can be corrected and reduced while the luminance of this bright pixel is retained. A person has a vision characteristic that makes the person perceive the brightness of a bright portion more intensely as the background is darker. Therefore, retaining the luminance of the bright pixel makes the luminance correction even less noticeable to the viewer.

For example, when a luminance of each pixel input in the correcting is defined as a first luminance and a luminance of each pixel subjected to a luminance correction in the correcting is defined as a second luminance, the correction method corrects, in each of the plurality of blocks, the first luminance of each pixel in a given block to the second luminance based on a number of pixels, within the given block, that have a first luminance higher than a first luminance threshold.

According to the above, the luminance of each pixel can be corrected based on the number of pixels having a luminance higher than the first luminance threshold in a given block. For example, the luminance can be corrected in accordance with the area of a bright portion.

For example, the correction method corrects the first luminance to reduce a difference between the first luminance and the second luminance more as the number of pixels is larger.

According to the above, the luminance of a pixel included in a given block is corrected and reduced by a smaller amount as the number of pixels having a luminance higher than the first luminance threshold is greater. In other words, when the area of a bright portion is large within a given block, the luminance can be corrected and reduced while the luminance of this bright pixel is retained, A person has a vision characteristic that makes the person perceive the brightness more intensely as the area of a bright portion is large. Therefore, retaining the area of the bright portion makes the luminance correction even less noticeable to the viewer.

For example, when a luminance of each pixel input in the correcting is defined as a first luminance and a luminance of each pixel subjected to a luminance correction in the correcting is defined as a second luminance, the correcting includes obtaining a first coefficient based on a difference between a mean value of the first luminance of each pixel in one block among the plurality of blocks and a maximum value of the first luminance of each pixel in the one block obtaining a second coefficient based on a number of pixels, within the one block, that have a first luminance higher than a first luminance threshold, and calculating the second luminance by correcting the first luminance of each pixel in the one block based on the first coefficient and the second coefficient.

According to the above, the luminance of each pixel in a block can be corrected in consideration of the two human vision characteristics, and thus the correction method becomes even less noticeable to the viewer.

For example, when the first coefficient is defined as Cmi, the second coefficient is defined as Cbi, a value higher than or equal to zero and lower than or equal to one is defined as α, and a third coefficient is defined as $Ci=\alpha\times Cmi+(1-\alpha)\times Cbi$, the calculating calculates the second luminance by correcting the first luminance of each pixel in the one block based on the third coefficient.

According to the above, the priorities of the two vision characteristics can be changed by changing coefficient α. Accordingly, the flexibility in correcting the luminance can be increased.

For example, when a luminance of each pixel input in the correcting is defined as a first luminance and a luminance of each pixel subjected to a luminance correction in the correcting is defined as a second luminance, the correcting includes setting, in each of the plurality of blocks, one virtual luminance based on a second representative luminance that is based on a luminance of a pixel in one block among the plurality of blocks and a darkening coefficient that is based on luminances of pixels in the one block, the virtual luminance being a representative luminance value in the one block; and correcting the first luminance of each pixel to the second luminance based on the virtual luminance set for each of the plurality of blocks.

According to the above, the use of the virtual luminance set for each block makes it possible to find the relative relationship of the brightness in each block. In addition, the luminance correction can be made less noticeable to the viewer by correcting the luminance of each pixel based on the relative relationship of the virtual luminance.

For example, in the correcting of the first luminance, a contribution of a first virtual luminance to a surrounding block in the one block is added to a second virtual luminance of the neighboring block, the contribution being based on a luminance distribution of the first virtual luminance in the one block among the plurality of blocks.

According to the above, the virtual luminance can be calculated based on the vision characteristic in which a person perceives the brightness of a bright portion more intensely as the background is darker. In addition, the luminance correction can be made less noticeable to the viewer by correcting the luminance of each pixel based on the virtual luminance.

For example, the darkening coefficient is calculated based on a difference between a mean value of a luminance of each pixel in the one block and a maximum value of a luminance of each pixel in the one block.

According to the above, the virtual luminance can be calculated based on the maximum value of the luminance of the pixels included in a given block for each of the plurality of blocks that have not been subjected to the luminance correction. In addition, the luminance correction can be made less noticeable to the viewer by correcting the luminance based on the virtual luminance.

For example the second representative luminance is a maximum value of a luminance of each pixel in the one block.

According to the above, the luminance can be corrected in consideration of the influence of the brightness of one block on the brightness of another block, and thus the correction method becomes even less noticeable to the viewer.

For example, the correction method includes bringing the second luminance to a second luminance threshold when the second luminance has fallen below the second luminance threshold.

According to the above, any change in the luminance difference that arises in the luminance correction can be suppressed when the luminance is reduced excessively in the correcting, and thus the luminance correction can be made less noticeable to the viewer.

For example, the luminance is not corrected after the correcting.

According to the above, the power consumption can be reduced reliably.

For example, the plurality of blocks have an identical shape.

According to the above, the luminance can be corrected in the plurality of blocks having an identical shape.

A luminance determining device according to one aspect of the present disclosure is a luminance determining device that determines a luminance of each pixel in a display device that includes a self emitting element, and the luminance determining device includes a controller that divides one image into a plurality of blocks that do not overlap each other and corrects, in each of the plurality of blocks, a luminance of each pixel by reducing the luminance in the plurality of blocks through a correction method determined for each of the plurality of blocks.

According to the above, the luminance determining device can correct and reduce the luminance in each block through the correction method determined for each block. Therefore, the luminance can be corrected more finely as compared to the case where the luminance is corrected based on a luminance gradient or the luminance is corrected uniformly in an entire screen. Accordingly, the luminance determining device according to one aspect of the present disclosure is less noticeable to a viewer and can extend the lifetime of the display device.

A video display apparatus according to one aspect of the present disclosure includes the luminance determining device described above and a display device that displays an image having a luminance determined by the luminance determining device and that includes a self emitting element.

According to the above, a video display apparatus that is less noticeable to the viewer and that includes a display device with an extended lifetime can be achieved.

Hereinafter, some embodiments will be described in concrete terms with reference to the drawings.

It is to be noted that the embodiments described below merely illustrate general or specific examples. The numerical values, the shapes, the materials, the constituent elements, the arrangement positions and the connection modes of the constituent elements, the steps, the orders of the steps, and so on illustrated in the following embodiments are examples and are not intended to limit the claims. Among the constituent elements in the following embodiments, any constituent element that is not described in the independent claims expressing the broadest concepts is to be construed as an optional constituent element.

Furthermore, the drawings do not necessarily provide the exact depictions. In the drawings, substantially identical configurations are given identical reference characters, and duplicate descriptions thereof will be omitted or simplified.

Embodiment 1

[1-1. Structure of Video Display Apparatus]

First, with reference to FIGS. 1 and 2, a structure of video display apparatus 10 that includes luminance determining device 30 according to the present embodiment will be described.

FIG. 1 illustrates an outer appearance of video display apparatus 10 according to the present embodiment. FIG. 2 is a block diagram illustrating a functional configuration of video display apparatus 10 according to the present embodiment.

As illustrated in FIG. 1, video display apparatus 10 according to the present embodiment is, for example but not limited to, a flat panel display apparatus that displays a video image, such as a television image. There is no particular limitation on the video image that video display apparatus 10 displays. A video image may be a moving image or a still image. A video image may include, for example but not limited to, letters and numbers. In the following description, a video image may also be referred to as an image.

Figure 2:
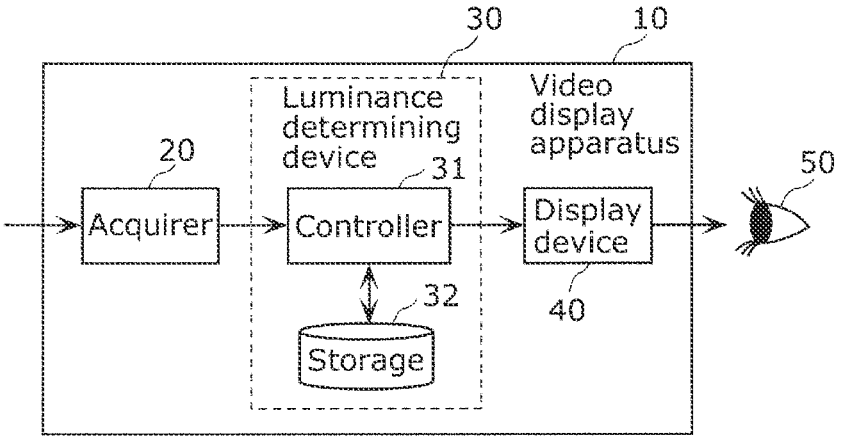
FIG. 2 is a block diagram illustrating a functional configuration of the video display apparatus according to Embodiment 1.

As illustrated in FIGS. 1 and 2, video display apparatus 10 includes acquirer 20, luminance determining device 30, and display device 40. In the example illustrated in the present embodiment, luminance determining device 30 is embedded in video display apparatus 10, Alternatively, luminance determining device 30 may be separate from video display apparatus 10.

Acquirer 20 acquires an image (an image signal) to be displayed by display device 40. In a case where video display apparatus 10 displays an image (e.g., a moving image) that is based on the airwaves for digital broadcasting or the like, acquirer 20 receives the digital airwaves and performs signal processing such as decoding. In this case, acquirer 20 includes at least one tuner, for example. The tuner extracts, from the airwaves received by an antenna (not illustrated), a signal for the channel selected by the user and demodulates this signal. Acquirer 20 receives an image to be displayed by display device 40 by receiving the airwaves. In a case where acquirer 20 acquires an image from a network, such as the internet, acquirer 20 is constituted by, for example but not limited to, a wireless communication module or a wired communication module. In a case where acquirer 20 acquires an image from a video playback device, a game console, or the like that plays back data (content) stored in a storage medium (e.g., a Blu-ray disc or the like), acquirer 20 is constituted by, for example but not limited to, a wired communication module or a wireless communication module.

Acquirer 20 outputs an acquired image to luminance determining device 30.

Luminance determining device 30 performs a predetermined correction on an image acquired from acquirer 20 and outputs the corrected image to display device 40. Luminance determining device 30 includes controller 31 and storage 32.

Controller 31 is a processor that performs a predetermined correction on an image acquired from acquirer 20. In a case where display device 40 includes an OLED, if an image acquired from acquirer 20 is output to display device 40 without any modification made to the grayscale value (i.e., the luminance) of the image, a large amount of power is consumed in display device 40, and this leads to a shorter lifetime of high-grayscale level (i.e., high-luminance) pixels. Furthermore, as a pixel approaches its lifetime, the burn-in in that pixel becomes more intense. Therefore, controller 31 performs a correction that makes it possible to extend the lifetime of display device 40. Specifically, controller 31 performs a correction of reducing the luminance of an image. If the luminance of an image is reduced uniformly in order to suppress the burn-in, the entire image becomes dark, and this makes it impossible to take advantage of the wide dynamic range, which is one advantage of an OLED. Accordingly, controller 31 performs the correction in consideration of vision characteristics of human eyes described below.

A first vision characteristic is that a person perceives the brightness of a bright portion more intensely as the background is darker. In other words, when a person sees a prominently bright portion in a generally dark environment, that bright portion is perceived brighter than a bright portion with the same luminance that is not in a generally dark environment. Accordingly, when there is a prominently bright portion in a generally dark environment, controller 31 corrects the luminance such that the amount of reduction in the luminance of that bright portion is smaller than the amount of reduction in the luminance of another area. Controller 31 may perform a correction of retaining the brightness of that bright portion, for example. This first vision characteristic is also referred to as vision characteristic 1.

A second vision characteristic is that a person perceives the brightness more intensely as the area of a bright portion is larger within a screen. Accordingly, controller 31 corrects the luminance such that the amount of reduction in the luminance of pixels in a region containing a large number of bright portions within a screen is smaller than the amount of reduction in the luminance of pixels in a region containing a large number of dark portions. When the area of a bright portion in a predetermined region is greater than or equal to a predetermined area, controller 31 may perform a correction of retaining the brightness in that predetermined region, for example. This second vision characteristic is also referred to as vision characteristic 2.

Controller 31 performs the correction of reducing the luminance in consideration of at least one of the two human vision characteristics described above. The process of controller 31 will be described later in detail.

The process performed by controller 31 is not limited to the above. Controller 31 may also perform processes other than the process for extending the lifetime of display device 40. Specifically, controller 31 may perform image quality adjusting processes that are performed conventionally, Controller 31 may perform processes such as a color (hue, color saturation, lightness) adjustment, a grayscale correction, an outline emphasis correction, and noise removal, for example. Any conventionally performed image quality adjusting process performed by controller 31 is also referred to as a typical image quality adjusting process. In addition, the process of reducing the luminance in consideration of the two human vision characteristics described above in order to extend the lifetime of display device 40 is also referred to as a luminance correcting process. In the present specification, the luminance correction is a correction of reducing the luminance. Therefore, the luminance held after the luminance correcting process is lower than or equal to the luminance held before the luminance correcting process.

Controller 31 is implemented by a microcomputer or a processor, for example.

Storage 32 is a storage device that stores a control program to be executed by controller 31. Storage 32 stores, for example but not limited to, a function and a lookup table for executing the typical image quality adjusting process and the luminance correcting process.

Display device 40 is a display that displays an image in accordance with an image signal output from luminance determining device 30. Display device 40 is a display that includes self emitting elements, such as an organic EL display, an inorganic EL display, or a micro LED display. A plurality of pixels are disposed in a lattice pattern or a honeycomb pattern in display device 40. Display device 40 may be a display that provides color display or a display that provides monochrome display. Person 50 views an image displayed on display device 40.

[1-2. Process Performed by Luminance Determining Device]

Now, with reference to FIGS. 3 to 7, a process performed by luminance determining device 30 according to the present embodiment will be described.

Figure 3:
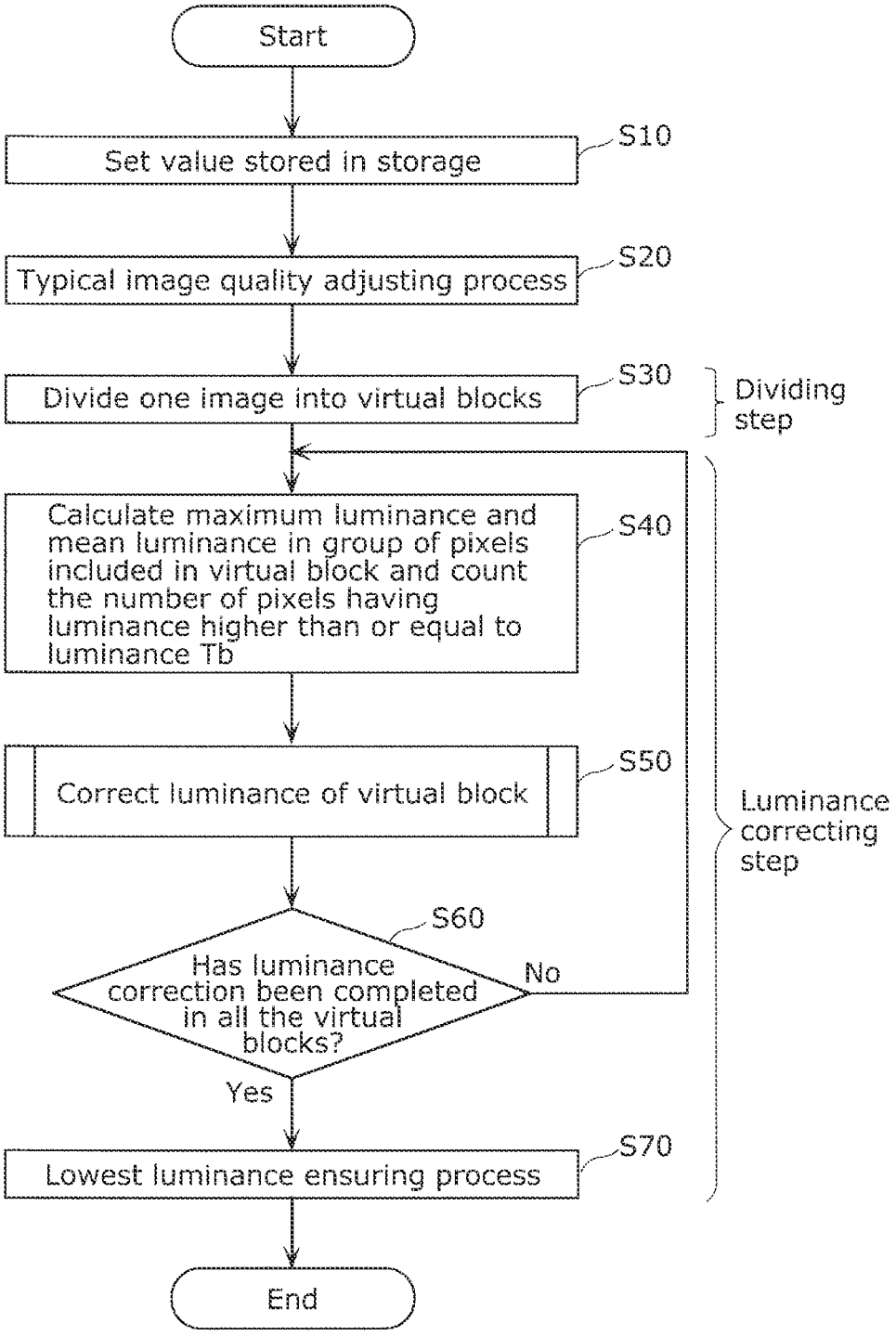
FIG. 3 is a flowchart illustrating an operation of a luminance determining device according to Embodiment 1.

FIG. 3 is a flowchart illustrating an operation of luminance determining device 30 according to the present embodiment. The process in the flowchart illustrated in FIG. 3 is performed for each image (each frame).

As illustrated in FIG. 3, controller 31 first reads out, and sets therein, values (setting values) for performing the typical image quality adjusting process and the luminance correcting process from storage 32 (S10), Then, of the typical image quality adjusting process and the luminance correcting process, controller 31 performs the typical image quality adjusting process first (S20). Specifically, controller 31 performs processes such as the color adjustment and the grayscale correction. Controller 31 performs the luminance correcting process (S30 to S70 illustrated in FIG. 3) after performing the typical image quality adjusting process. The image that has been subjected to the luminance correcting process does not have its luminance corrected in the processes following the luminance correcting process. In other words, in the image processing performed by controller 31, the luminance correcting process is carried out in the final stage. Then, the image that has been subjected to the luminance correcting process is displayed by display device 40.

In the luminance correcting process, first, a process of dividing one image into virtual blocks that do not overlap each other is performed (S30). In order to perform the luminance correction appropriate for the image to be displayed, controller 31 divides the screen of display device 40 that includes self emitting elements into a plurality of virtual blocks that do not overlap each other. In other words, controller 31 divides one image to be displayed on the screen of display device 40 into a plurality of virtual blocks, Therefore, the correction amount (the amount of reduction in the luminance) in the luminance correcting process varies depending on the image. Step S30 is an example of a dividing step.

Now, with reference to FIG. 4, the virtual blocks will be described.

Figure 4:
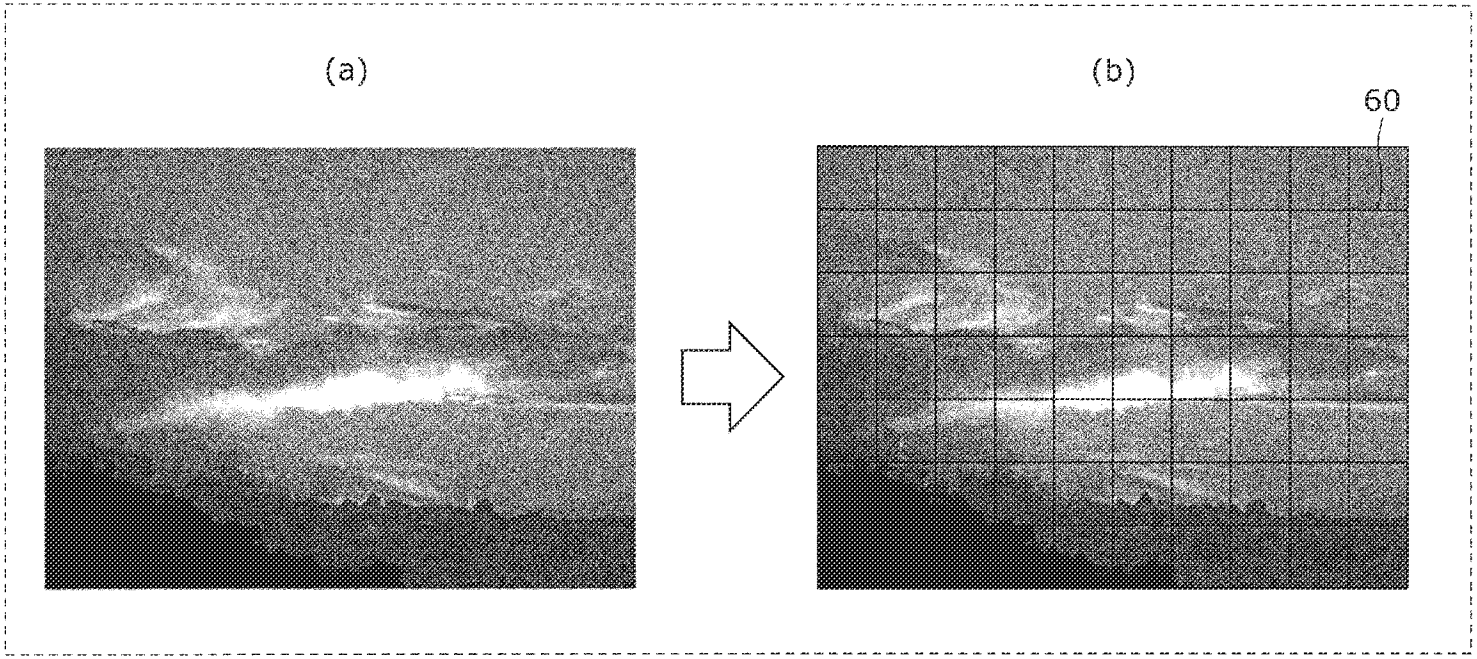
FIG. 4 schematically illustrates how an image is divided into virtual blocks according to Embodiment 1.

FIG. 4 schematically illustrates how an image is divided into virtual blocks according to the present embodiment. FIG. 4 illustrates an image of an evening glow as an example.

In FIG. 4, (a) illustrates an image that has been subjected to the typical image quality adjusting process. The image illustrated in (a) in FIG. 4 is an image that has not been divided into virtual blocks 60.

In FIG. 4, (b) illustrates how the image has been divided into the plurality of virtual blocks 60 in step S30. In the example illustrated in (b) in FIG. 4, the single image is divided into seven blocks vertically and ten blocks horizontally. However, there is no particular limitation on the number of blocks into which one image is to be divided. In addition, in the example illustrated in (b) in FIG. 4, each of the plurality of virtual blocks 60 has an identical shape, but this is not a limiting example. Controller 31 may vary the size of virtual blocks 60 between a center portion and a peripheral portion of an image. For example, controller 31 may set the size of virtual blocks 60 in the center portion of an image to which a person tends to pay closer attention smaller than the size of virtual blocks 60 in the peripheral portion of the image. The shape of each virtual block 60 is not limited to a rectangle, and each virtual block 60 may be polygonal or circular. In addition, a single image may include virtual blocks 60 of varying shapes. Each of the plurality of virtual blocks 60 includes two or more pixels (a group of pixels). In the following description, virtual block 60 is also referred to simply as block 60, Virtual block 60 is a virtual region that is set for performing the luminance correcting process described below.

Referring back to FIG. 3, controller 31 calculates a maximum luminance and a mean luminance in the group of pixels included in each block 60 and counts the number of pixels, within that group of pixels, that have a luminance higher than or equal to luminance Tb (S40), In other words, controller 31 calculates the luminance of each block 60 and counts the number of pixels in each block 60. In order to perform the luminance correction in consideration of the first vision characteristic, controller 31 calculates the maximum luminance and the mean luminance in each of the plurality of blocks 60, In addition, in order to perform the luminance correction in consideration of the second vision characteristic, controller 31 counts, in each of the plurality of blocks, the number of pixels that are included in a given block and that have a luminance higher than or equal to luminance Tb. In a case where the virtual blocks vary in size, the total number of pixels in each virtual block may be counted in advance.

Controller 31 calculates, as the maximum luminance, the luminance of the pixel having the highest luminance among a plurality of pixels within one block of the plurality of blocks 60 and calculates, as the mean luminance, the mean value of the luminances of the plurality of pixels within the one block. The mean luminance is an example of a first representative luminance, and the maximum luminance is an example of a bright luminance that is higher than the mean luminance. The first representative luminance is not limited to the mean luminance. The first representative luminance may instead be a median luminance that is a median value between the maximum luminance and the minimum luminance of the pixels included in one block 60. Furthermore, the first representative luminance may be a median value between the mean value of a plurality of bright luminances and the mean value of a plurality of dark luminances. In addition, the bright luminance is not limited to the maximum luminance. The bright luminance may instead be the second brightest luminance within one block, the third brightest luminance within one block, or a mean value of a plurality of bright luminances (e.g., the top five bright luminances within one block 60). The pixel for calculating the bright luminance may be a pixel that is selected from the pixels used to calculate the first representative luminance and that has a luminance higher than the first representative luminance, for example. In the present embodiment, since the first representative luminance is the mean value of the luminances of all the pixels composing given block 60, the pixel for calculating the bright luminance is selected from the pixels, within that block 60, that have a luminance higher than the first representative luminance.

Although the details will be provided later, controller 31 may reduce the luminance of each pixel composing a given block by a smaller amount as the luminance of the bright luminance is higher relative to the first representative luminance. In consideration of the first vision characteristic described above, as the brightness of the bright luminance is higher, controller 31 performs a correction of retaining the luminance of the block that includes that bright luminance. Herein, to retain the luminance means that the luminance of a given pixel is substantially equal to the luminance held before the luminance correction or that the amount of reduction in the luminance is smaller in a given block than in other blocks.

Controller 31 counts the number of pixels, among the pixels included in one block, that have a luminance higher than or equal to luminance Tb. Luminance Tb is a value set in advance and is an example of a first luminance threshold. Herein, one luminance Tb is set for each image. In other words, luminance Tb is a value common to the plurality of blocks 60.

In a case where the number of pixels included in each block differs among the plurality of blocks 60, in step S40, controller 31 may calculate the proportion of the number of pixels having a luminance higher than or equal to luminance Tb in a given block relative to the total number of pixels included in that block.

Next, controller 31 corrects the luminance of each block 60 (S50). Controller 31 corrects the luminance of each of the plurality of blocks 60. In the present embodiment, one correction coefficient (a darkening coefficient) is determined for each block 60, and all the pixels included in one block 60 are darkened uniformly. Now, with reference to FIGS. 5A and 5B, step S50 will be described in detail. Specifically, in the example described below, the luminance is corrected in consideration of the first vision characteristic.

Figure 5A:
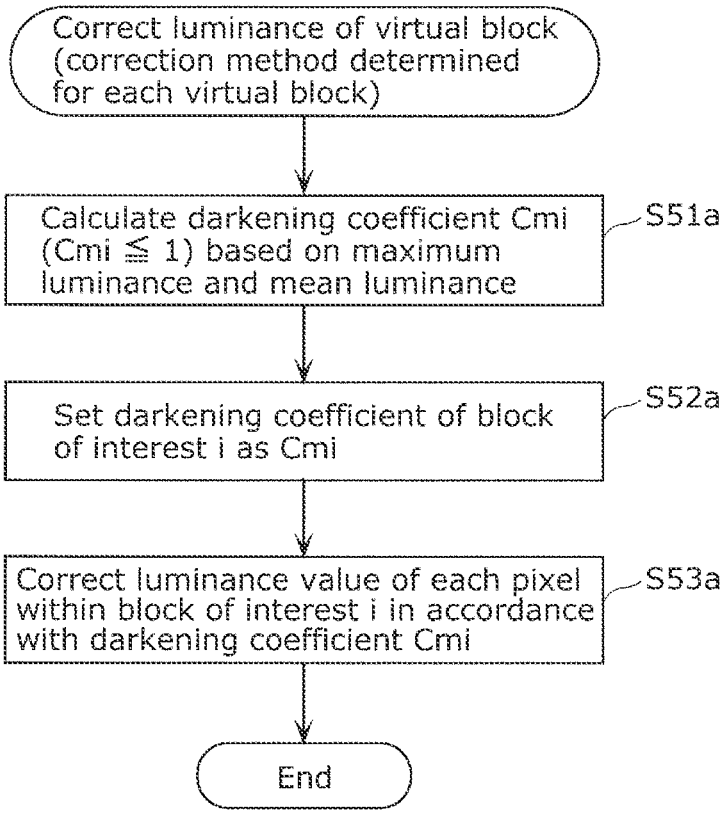
FIG. 5A illustrates an example of a flowchart of a correction method according to Embodiment 1.

FIG. 5A illustrates an example of a flowchart of a correction method according to the present embodiment. As described above, luminance determining device 30 corrects the luminance of each of the plurality of blocks 60. In other words, the method of correcting the luminance is determined for each of the plurality of blocks 60.

As illustrated in FIG. 5A, first, controller 31 calculates darkening coefficient Cmi based on the maximum luminance and the mean luminance in block of interest i, which is a block to be subjected to the luminance correction, among the plurality of blocks 60 (S51*a*). Darkening coefficient Cmi is a correction coefficient for correcting (reducing) the luminance of the pixels included in block of interest i. Darkening coefficient Cmi is calculated based on the difference between the maximum luminance and the mean luminance, Specifically, darkening coefficient Cmi is calculated, for example, through Expression 1 below, in which Nmax(n) is the maximum pixel value (e.g., 255 in the case of 8-bit data) held when the resolution of the luminance is n-bit, Vmi is the maximum luminance in block of interest i, Vai is the mean luminance in block of interest i, and Di (=Vmi−Vai) is the difference between the maximum luminance and the mean luminance.

$$Cmi=(1-Cm)\times Di/N\max(n)+Cm \quad \text{(Expression 1)}$$

Herein, Cm in Expression 1 assumes a value that satisfies $0<Cm<1$.

As indicated by Expression 1, darkening coefficient Cmi assumes a value smaller than one, Specifically, darkening coefficient Cmi assumes a numerical value that is closer to one as the difference between the maximum luminance and the mean luminance is greater. Conversely, Cmi=Cm holds if the difference between the maximum luminance and the mean luminance is zero, and this makes Cm darkening coefficient Cmi to be held when the effect of darkening is at maximum. In other words, Cm is a value that indicates the minimum value of darkening coefficient Cmi. Minimum value Cm may be a value set in advance, for example. Minimum value Cm may be a value that is set to approach one as the difference between the maximum luminance and the mean luminance is greater.

The use of darkening coefficient Cmi described above allows the amount of darkening to be reduced when there is a prominently bright portion (pixels) in block of interest i. For example, darkening coefficient Cmi is approximately 0.84 (the luminance is reduced to 84% of the original luminance) when maximum pixel value Nmax(n) is 255 (8-bit), the pixel value corresponding to maximum luminance Vmi is 200, the pixel value corresponding to mean luminance Vai is 150, and Cm is 0.8. In Expression 1, the relationship between darkening coefficient Cmi and difference Di between the maximum luminance and the mean luminance (difference Di is also referred to below as luminance difference Di) is linear. However, it suffices that darkening coefficient Cmi follow a monotonic increase function of luminance difference Di within a possible range of luminance difference Di.

Next, controller 31 sets the darkening coefficient of block of interest i as darkening coefficient Cmi (S52*a*) and corrects the luminance value of each pixel within block of interest i in accordance with darkening coefficient Cmi (S53*a*). Specifically, controller 31 corrects the luminance of a given pixel by multiplying the luminance value of that pixel by darkening coefficient Cmi, Controller 31 corrects the luminance of each pixel held before the luminance correction in accordance with darkening coefficient Cmi and calculates the luminance to be held after the luminance correction. The luminance of each pixel held before the luminance correction is an example of a first luminance, and the luminance held after the luminance correction is an example of a second luminance. The second luminance is lower than or equal to the first luminance. Controller 31 corrects the luminance such that the difference between the first luminance and the second luminance is smaller as the difference between the maximum luminance and the mean luminance is greater.

With this process, controller 31 can correct the luminance of block of interest i in consideration of the first vision characteristic. When there is a prominently bright portion (pixels) in block of interest i, the amount of darkening is small as compared to a case where there is no prominently bright portion (pixels) or the prominence of a bright portion is low (i.e., the difference between the maximum luminance and the mean luminance is small). Therefore, the viewer can perceive the brightness even in the image that has been subjected to the luminance correction. In other words, the luminance correction is less noticeable to the viewer. In addition, the amount of darkening is large in block 60 in which the maximum luminance and the mean luminance are both low. Therefore, the power consumed in display device 40 can be reduced, and the lifetime of display device 40 can be extended.

In a case where darkening coefficient Cmi for correcting the first luminance is calculated through Expression 3 described later, the number of pixels having a luminance higher than or equal to luminance Tb is counted in step S40. In addition, the mean luminance can be calculated by dividing the cumulative luminance of individual pixels included in given block of interest i by the number of pixels in that block of interest i. Darkening coefficient Cmi is an example of a first coefficient.

Referring back to FIG. 3, after step S50, it is determined whether the correction of the luminance has been completed in all the blocks (S60). Controller 31 calculates darkening coefficient Cmi and corrects the luminance in each of the plurality of blocks 60. If it is determined that controller 31 has corrected the luminance in all of the plurality of blocks (Yes in S60), a lowest luminance ensuring process is performed (S70).

In the lowest luminance ensuring process, the second luminance is brought to a predetermined luminance if the second luminance has fallen below the predetermined luminance. When display device 40 is displaying a moving image, bright pixels change over time. Meanwhile, since the plurality of blocks 60 are fixed, the number of bright pixels included in each block 60 changes over time. If the number of bright pixels in given block 60 changes excessively (e.g., many→few→many), this block 60 may look as if it became bright and dark alternately. Therefore, controller 31 brings the second luminance to a predetermined luminance set in advance when the second luminance has reached or fallen below the predetermined luminance, and this can keep the difference in the luminance held before and after the correction from reaching or exceeding a predetermined value. Accordingly, the luminance difference between the bright luminance and the dark luminance held before and after the correction is reduced, and controller 31 can thus suppress a phenomenon in which a block looks as if it became bright and dark alternately. The predetermined luminance is, for example, such a luminance that makes it less noticeable to a viewer when the block is darkened to that luminance from the maximum pixel value (e.g., 255 in the case of 8-bit data) held when the resolution of the luminance is n-bit. In one example, the predetermined luminance is a luminance corresponding to the value that is one half the maximum pixel value (e.g., 128 in the case of 8-bit data). The predetermined luminance is an example of a second luminance threshold.

Figure 5B:
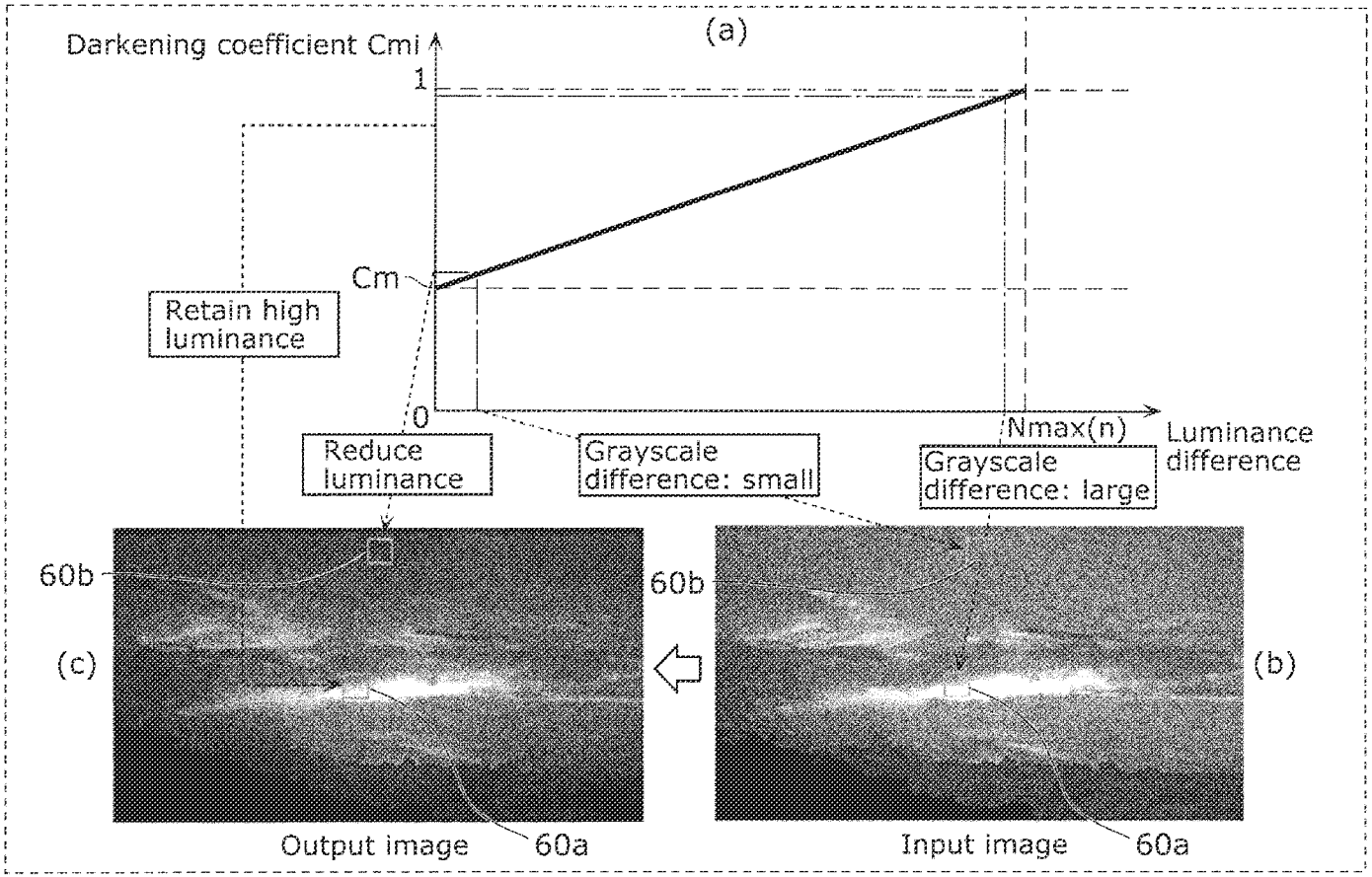
FIG. 5B illustrates an image that is to be subjected to a luminance correction and an image that has been subjected to the luminance correction through the correction method illustrated in FIG. 5A according to Embodiment 1.

FIG. 5B illustrates an image that is to be subjected to the luminance correction and an image that has been subjected to the luminance correction through the correction method illustrated in FIG. 5A according to the present embodiment. In FIG. 5B, (a) is a graph illustrating a relationship between the luminance held before the luminance correction and the luminance held after the luminance correction, (b) is an image (an input image) that is to be subjected to the luminance correction, and (c) is an image (an output image) that has been subjected to the luminance correction. The output image is displayed on display device 40. The rectangular frames in (b) and (c) in FIG. 5B each represent one block 60 within the images.

In (a) in FIG. 5B, the horizontal axis indicates the luminance difference between the maximum luminance and the mean luminance within block 60 held before the luminance correction, and the vertical axis indicates the luminance (the maximum luminance held after the luminance correction) within block 60 held after the luminance correction.

As illustrated in (a) in FIG. 5B, the luminance held after the luminance correction is greater as the luminance difference (the grayscale difference) within block 60 is greater. In other words, the luminance value of the maximum luminance included in block 60 subjected to the luminance correction is higher.

Block 60*a* that has a large luminance difference (the grayscale difference) in (b) in FIG. 5B retains a high luminance in (c) in FIG. 5B. Meanwhile, block 60*b* that has a small luminance difference in (b) in FIG. 5B has a much lower luminance in (c) in FIG. 5B than blocks having a large luminance difference. Controller 31 reduces, by a greater amount, the luminance of block 60*b* of which the brightness does not need to be retained.

Referring back to FIG. 3, if it is determined that controller 31 has not corrected the luminance of all of the plurality of blocks 60 (No in S60), the flow returns to step S40, and the processes in steps S40 and S50 are performed in remaining blocks 60. There is no particular limitation on the order in which steps S40 and S50 are performed in the plurality of blocks 60. In one example, however, steps S40 and S50 are performed in raster order.

Steps S40 to S70 described above are an example of a luminance correcting step. In the luminance correcting step, the correction of reducing the luminance is performed on the pixels within the plurality of blocks 60 through the correction method determined for each of the plurality of blocks 60. In addition, the first luminance is the luminance of each pixel input in the luminance correcting step and is, for example, the luminance obtained after the typical image quality adjusting process has been performed in step S20. Correcting the luminance through step S40 and S50 is an example of the correction method determined for each of the plurality of blocks 60.

Figure 6A:
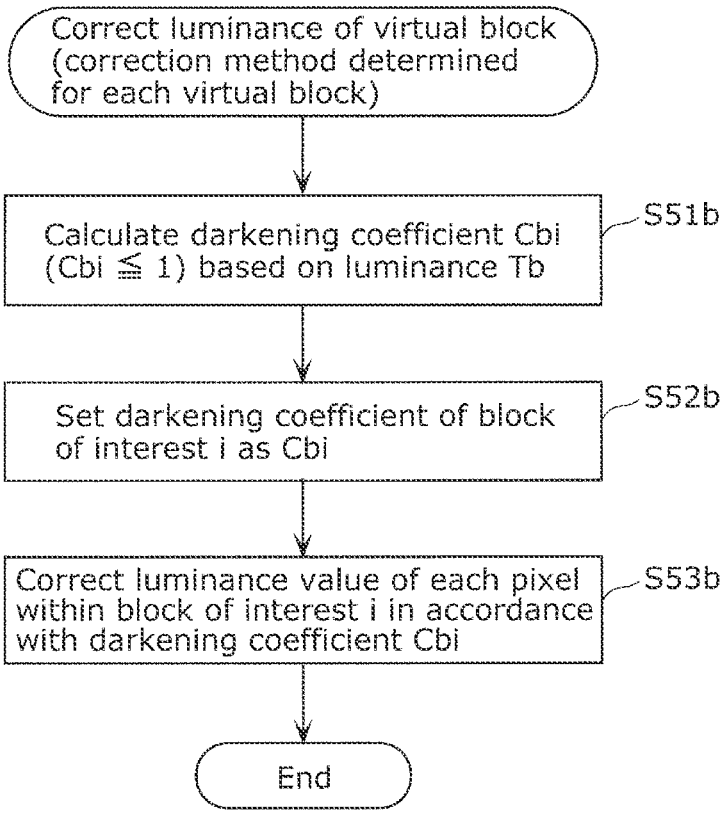
FIG. 6A illustrates another example of the flowchart of the correction method according to Embodiment 1.

The method of correcting the luminance by controller 1 is not limited to the correction method described above. With reference to FIGS. 6A to 7, another example of the method of correcting the luminance by controller 31 will be described.

FIG. 6A illustrates another example of the flowchart of the correction method according to the present embodiment, FIG. 6A illustrates another example of the process performed in step S50 in FIG. 3. Specifically, an example in which the luminance is corrected in consideration of the second vision characteristic will be described with reference to FIG. 6A.

As illustrated in FIG. 6A, first, controller 31 calculates darkening coefficient Cbi based on luminance Tb in block of interest i, which is a block to be subjected to the luminance correction, among the plurality of blocks 60 (S51*b*). Darkening coefficient Chi is a correction coefficient for correcting the luminance of the pixels included in block of interest i. Darkening coefficient Cbi is calculated based on the number of pixels, among the plurality of pixels included in block of interest i, that have a luminance higher than or equal to luminance Tb, Specifically, darkening coefficient Cbi is calculated through Expression (2) below, in which Ntot is the number of pixels included in block of interest i, Tb is the threshold of the luminance regarded to be a high luminance, and Ni is the number of pixels having a luminance value higher than or equal to luminance Tb in block of interest i.

$$Cbi=(1-Cb)\times Ni/Ntot+Cb \quad \text{(Expression 2)}$$

Herein, Cb in Expression 2 assumes a value that satisfies $0<Cb<1$.

As indicated by Expression 2, darkening coefficient Cbi assumes a value smaller than or equal to one. Specifically, darkening coefficient Cbi assumes a value that is closer to one as the number of pixels having a luminance value higher than or equal to luminance Tb is greater, Conversely, Cbi=Cb holds if the number of pixels having a luminance value higher than or equal to luminance Tb is zero, and this makes Cb darkening coefficient Cbi to be held when the effect of darkening is at maximum. In other words, Cb is a value that indicates the minimum value of darkening coefficient Chi. Minimum value Cb may be a value set in advance, for example. Minimum value Cb may be a value that is set to approach one, for example, as luminance Tb is lower in accordance with the value of luminance Tb.

The use of darkening coefficient Cbi described above allows the amount of darkening to be reduced when there are many prominently bright portions (pixels) in block of interest i. For example, darkening coefficient Cbi is approximately 0.84 if minimum value Cb is 0.8 when number of pixels Ntot is 256 (e.g., 16 pixels vertically by 16 pixels horizontally) and number of pixels Ni is 50 while luminance Tb is 180, Expression 2 relates only to number of pixels Ni. Therefore, there is no difference in darkening coefficient Cbi between when number of pixels Ni is 50 while luminance Tb is 180 and when number of pixels Ni is 50 while luminance Tb is 200. However, the latter case clearly presents a brighter state and is a case where the brightness should be retained. Therefore, if this intention is to be incorporated into Expression 2, another term related to luminance Tb needs to be further added.

Next, controller 31 sets the darkening coefficient of block of interest i as darkening coefficient Cbi (S52*b*) and corrects the luminance value of each pixel within block of interest i in accordance with darkening coefficient Cbi (S53*b*). Specifically, controller 31 corrects the luminance of a given pixel by multiplying the luminance value of that pixel by darkening coefficient Cbi. Controller 31 corrects the luminance of each pixel held before the luminance correction in accordance with darkening coefficient Cbi and calculates the luminance to be held after the luminance correction. The luminance of each pixel held before the luminance correction is an example of the first luminance, and the luminance held after the luminance correction is an example of the second luminance. The second luminance is lower than or equal to the first luminance. Controller 31 corrects the luminance such that the difference between the first luminance and the second luminance is smaller as number of pixels Ni is greater.

With this process, controller 31 can correct the luminance of block of interest i in consideration of the second vision characteristic. When there are many prominently bright portions (pixels) in block of interest i, the amount of darkening is small as compared to a case where there is no prominently bright portion (pixels) or the prominence of a bright portion is low (i.e., the number of pixels having a luminance higher than or equal to luminance Tb is small). Therefore, the viewer can perceive the brightness even in the image that has been subjected to the luminance correction. In other words, the luminance correction is less noticeable to the viewer. In addition, the amount of darkening is large in block 60 in which number of pixels Ni is small, Therefore, the power consumed in display device 40 can be reduced, and the lifetime of display device 40 can be extended. Darkening coefficient Cbi is an example of a second coefficient.

Figure 6B:
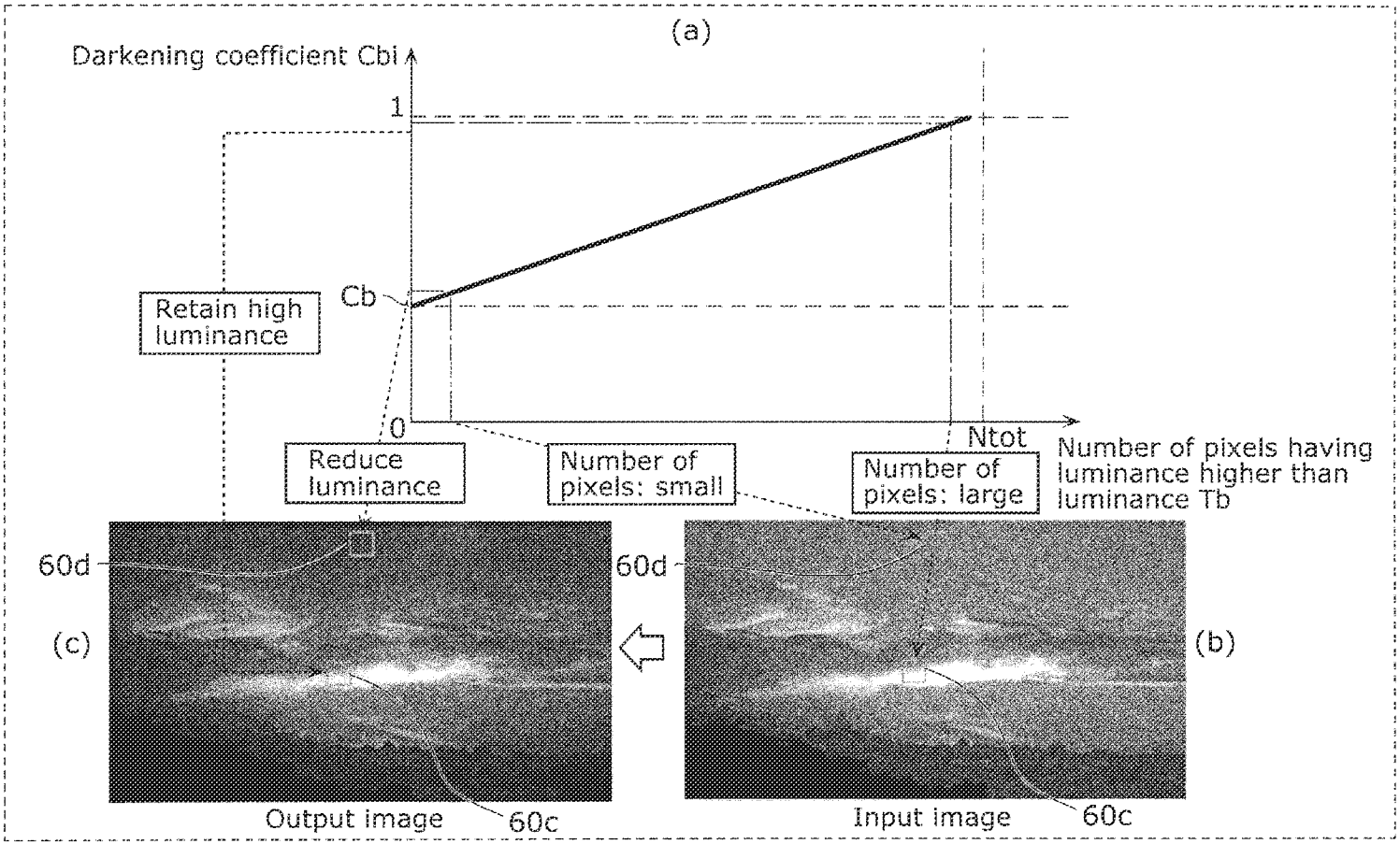
FIG. 6B illustrates an image that is to be subjected to a luminance correction and an image that has been subjected to the luminance correction through the correction method illustrated in FIG. 6A according to Embodiment 1.
Figure 7:
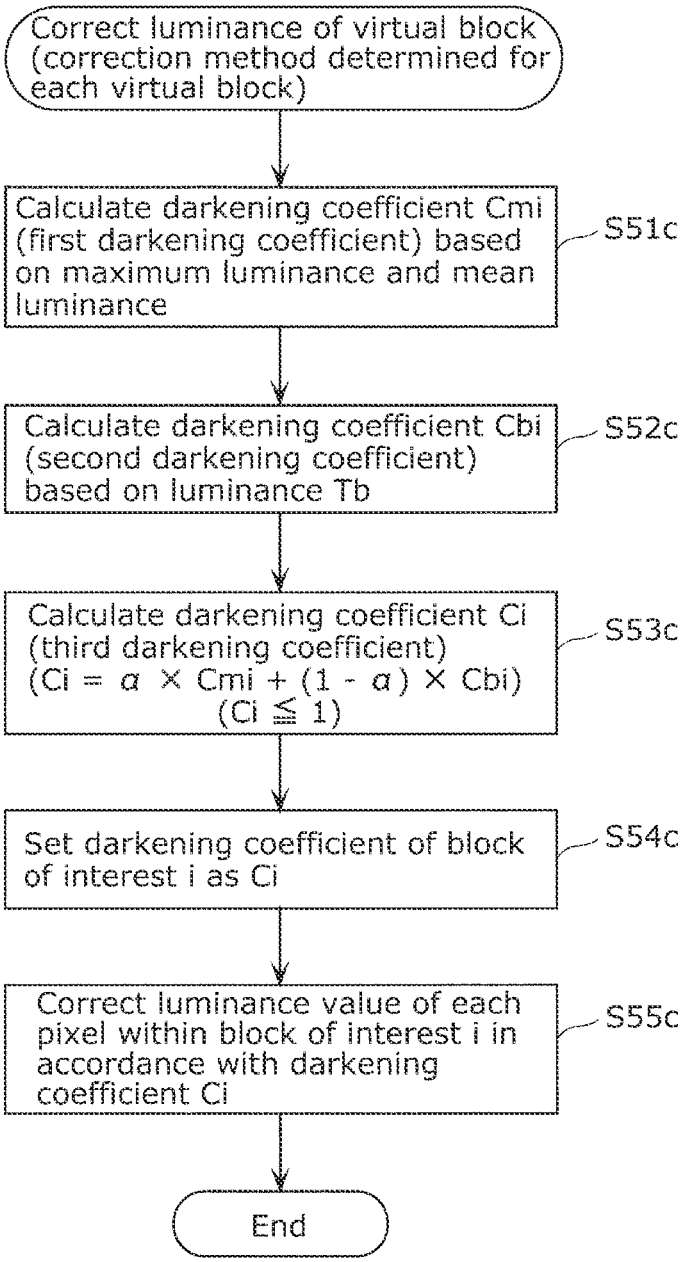
FIG. 7 illustrates yet another example of the flowchart of the correction method according to Embodiment 1.

FIG. 6B illustrates an image that is to be subjected to the luminance correction and an image that has been subjected to the luminance correction through the correction method illustrated in FIG. 6A according to the present embodiment. In FIG. 6B, (a) is a graph illustrating a relationship between the luminance held before the luminance correction and the luminance held after the luminance correction, (b) is an image (an input image) that is to be subjected to the luminance correction, and (c) is an image (an output image) that has been subjected to the luminance correction. The rectangular frames in (b) and (c) in FIG. 6B each represent one block within the images.

In (a) in FIG. 6B, the horizontal axis indicates number of pixels Ni, within a block, that have a luminance higher than or equal to luminance Tb before the luminance correction, and the vertical axis indicates the luminance (the maximum luminance held after the luminance correction) within block 60 held after the luminance correction.

As illustrated in (a) in FIG. 6B, the luminance held after the luminance correction is higher as number of pixels Ni within one block 60 is greater. In other words, the luminance value of the maximum luminance in block 60 subjected to the luminance correction is high.

Block 60*c* that has large number of pixels Ni in (b) in FIG. 6B retains a high luminance in (c) in FIG. 6B. Meanwhile, block 60*d* that has small number of pixels Ni in (b) in FIG. 6B has a much lower luminance in (c) in FIG. 6B than block 60*c* that has large number of pixels Ni.

FIG. 7 illustrates yet another example of the flowchart of the correction method according to the present embodiment, FIG. 7 illustrates yet another example of the process performed in step S50 in FIG. 3. Specifically, an example in which the luminance is corrected in consideration of both the first vision characteristic and the second vision characteristic will be described with reference to FIG. 7.

For example, according to Expression 1, the rate of darkening is high if the difference between the maximum luminance and the mean luminance is small. However, there may be a case where not much darkening is desired and the brightness should be retained if a block is generally very bright and this brightness of that block is close to the maximum luminance. In the example described below, in consideration of the darkening in Expression 2 as well, the rate of darkening is lowered (the darkening coefficient is not reduced) if the number of pixels having a luminance higher than a given threshold luminance is large.

As illustrated in FIG. 7, first, controller 31 calculates darkening coefficient Cmi (an example of the first coefficient) based on the maximum luminance and the mean luminance in block of interest i, which is a block to be subjected to the luminance correction, among the plurality of blocks 60 (S51*c*). This step is similar to step S51*a* illustrated in FIG. 5A, and thus description thereof will be omitted. In addition, controller 31 calculates darkening coefficient Cbi (an example of the second coefficient) based on luminance Tb in block of interest i (S52*c*). This step is similar to step S51*b* illustrated in FIC. 6A, and thus description thereof will be omitted. Step S51*c* is an example of a first sub-step of obtaining the first coefficient, and step S52*c* is an example of a second sub-step of obtaining the second coefficient.

Next, controller 31 corrects the luminance of each pixel within block 60 based on darkening coefficient Cmi and darkening coefficient Cbi, Controller 31 calculates darkening coefficient Ci (S53*c*), Darkening coefficient Ci is a coefficient for taking the first vision characteristic and the second vision characteristic into consideration. Darkening coefficient Ci is calculated through Expression (3) below, in which coefficient $\alpha = Di/Nmax(n)$ assumes a value higher than or equal to zero and lower than or equal to one ($0 \leq \alpha \leq 1$).

$$Ci = \alpha \times Cmi + (1-\alpha) \times Cbi \quad \text{(Expression 3)}$$

Darkening coefficient Ci is a correction coefficient for correcting the luminance of the pixels included in block of interest i. Coefficient $\alpha$ is a blending rate of the darkening coefficient (weighting coefficient).

As indicated by Expression 3, it can be said that the influence of Cmi (the darkening coefficient associated with vision characteristic 1) is greater when a is qualitatively closer to one and that the influence of Cbi (the darkening coefficient associated with vision characteristic 2) is greater when $\alpha$ is closer to zero.

In other words, as the influence of Cbi becomes greater when a block is generally bright and the difference between the maximum luminance and the mean luminance is small (when $\alpha$ is close to zero), the value of Cbi is high since the block is generally bright, Therefore, the magnitude of darkening coefficient Ci is retained (the rate of darkening is small).

Herein, instead of weighting darkening coefficients Cmi and Cbi as in Expression 3, the mean value of darkening coefficients Cmi and Cbi (i.e., the value obtained when coefficient $\alpha$ is 0.5) may be used as darkening coefficient Ci. Darkening coefficient Ci (C) is an example of a third luminance.

Next, controller 31 sets the darkening coefficient of block of interest i as darkening coefficient Ci (S54*c*) and corrects the luminance value of each pixel within block of interest i in accordance with darkening coefficient Ci (S55*c*). Specifically, controller 31 corrects the luminance of a given pixel by multiplying the luminance value of that pixel by darkening coefficient Ci, Steps S53*c* to S55*c* are an example of a third sub-step of correcting the first luminance to calculate the second luminance. The first to third sub-steps (S51*c* to S55*c*) are included in the luminance correcting step.

With this process, controller 31 can correct the luminance of block of interest i in consideration of the first vision characteristic and the second vision characteristic. In addition, the flexibility in the luminance correction can be increased by adjusting the weight (coefficient $\alpha$) in accordance with the properties of the two vision characteristics.

[1-3. Advantageous Effects and Others]

According to the luminance determining method illustrated in FIG. 3 and so on, one image is divided into a plurality of virtual blocks 60, and the correction of reducing the luminance is performed in consideration of at least one of the first vision characteristic and the second vision characteristic for each of the plurality of virtual blocks 60. Therefore, the luminance correction is less noticeable to the viewer, and the lifetime of display device 40 can be extended. Furthermore, the luminance determining method makes it possible to correct and reduce the luminance in accordance with the image to be displayed on display device 40.

Embodiment 2

[2-1. Process Performed by Luminance Determining Device]

Now, with reference to FIGS. 8 to 16, a process performed by luminance determining device 30 according to the present embodiment will be described. In the present embodiment, features that differ from those of Embodiment 1 will be described, and descriptions of configurations similar to those of Embodiment 1 may be omitted or simplified in some cases. For example, the configuration of luminance determining device 30 and the configuration of video display apparatus 10 that includes luminance determining device 30 are similar to those of Embodiment 1, and thus descriptions thereof will be omitted.

Figure 8:
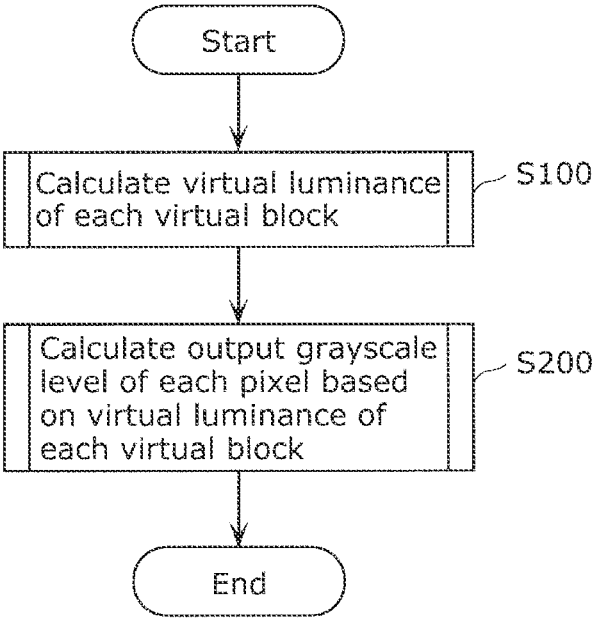
FIG. 8 is a flowchart illustrating an operation of a luminance determining device according to Embodiment 2.

FIG. 8 is a flowchart illustrating an operation of luminance determining device 30 according to the present embodiment. When display device 40 is displaying a moving image, the position of bright pixels changes over time. Meanwhile, since the plurality of virtual blocks 60 are fixed, the number of bright pixels included in each virtual block 60 changes over time. If the number of bright pixels in given virtual block 60 changes excessively (e.g., many→few→many), this virtual block 60 may look as if it became bright and dark alternately. Therefore, controller 31 performs the process illustrated in FIG. 8 to suppress an occurrence of such brightness and darkness.

As illustrated in FIG. 8, the virtual luminance of each virtual block 60 is calculated (S100), and then the process of calculating the output grayscale level (i.e., the luminance) of each pixel based on the virtual luminance of each virtual blocks 60 is performed (S200). The virtual luminance is a luminance set for each virtual block 60 in order to grasp the relative relationship of the luminances of virtual blocks 60. In the present embodiment, the virtual luminance is the maximum luminance of the pixels within virtual block 60 subjected to the luminance correction. The virtual luminance is calculated by multiplying the maximum luminance within virtual block 60 that has not been subjected to the luminance correction by the darkening coefficient (e.g., darkening coefficient Cmi) described in Embodiment 1.

In the present embodiment, the luminance is corrected in consideration of, in addition to the vision characteristics of human eyes, the influence of the luminance of one virtual block 60 on the luminance of another virtual block 60 (e.g., virtual block 60 located in the surroundings of one virtual block 60). In step S100, a representative luminance (a virtual luminance) of one virtual block 60 is calculated for calculating the influence of the luminance of this one virtual block 60 on the luminance of another virtual block 60. In step S200, the luminance is corrected in each pixel in consideration of the influence on the luminance of stated other virtual block 60 in accordance with the virtual luminance calculated in step S100 and the luminance distribution of the calculated virtual luminance. Controller 31 executes steps S100 and S200 illustrated in FIG. 8, in place of steps S40 to S60 illustrated in FIG. 3. Steps S100 and S200 are an example of the luminance correcting step.

First, with reference to FIGS. 9 and 10, step S100 will be described.

Figure 9:
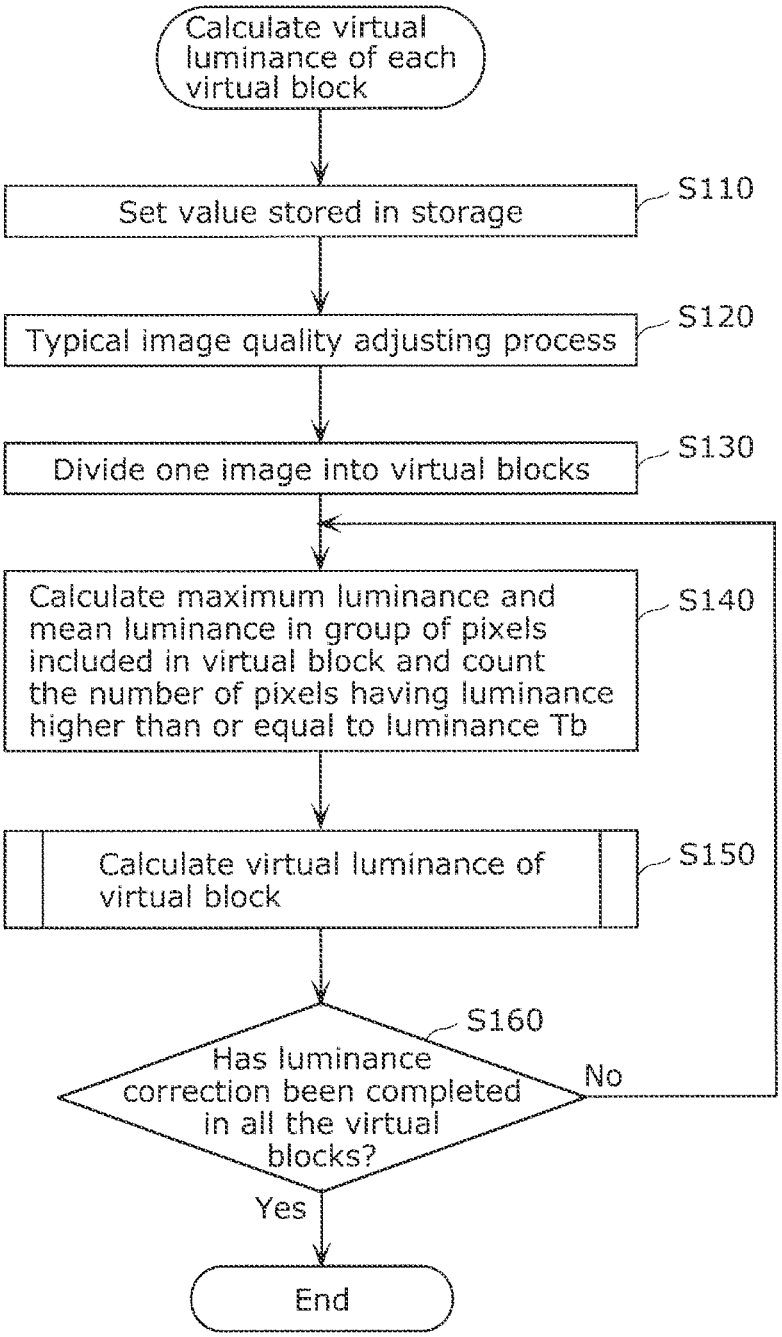
FIG. 9 is a flowchart illustrating a method of calculating a virtual luminance of each virtual block referred to in FIG. 8.
Figure 10:
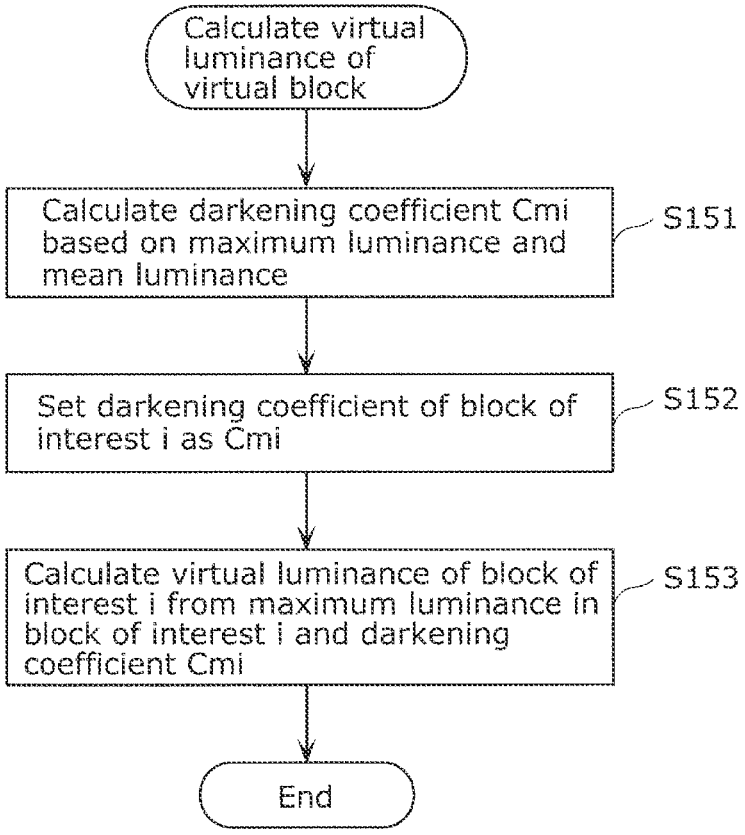
FIG. 10 is a flowchart illustrating a method of calculating a virtual luminance of each virtual block referred to in FIG. 9.

FIG. 9 is a flowchart illustrating the method of calculating the virtual luminance of each virtual block 60 referred to in FIG. 8 (S100), FIG. 10 is a flowchart illustrating a method of calculating the virtual luminance of each virtual block 60 referred to in FIG. 9. Steps S110 to S140 illustrated in FIG. 9 are similar to steps S10 to S40 illustrated in FIG. 3, and thus descriptions thereof will be omitted. In addition, the method of calculating the virtual luminance illustrated in FIG. 10 can be performed with the use of darkening coefficient Cmi, Cbi, or Ci described in Embodiment 1. In the following example, a method of calculating the virtual luminance with the use of darkening coefficient Cmi Will be described.

As illustrated in FIG. 9, controller 31 calculates the virtual luminance of virtual block 60 based on the maximum luminance and so on calculated in step S140 (S150). As illustrated in FIG. 10, the virtual luminance is calculated through three steps S151 to S153. Steps S151 to S153 are an example of the first sub-step.

First, controller 31 calculates darkening coefficient Cmi based on the maximum luminance and the mean luminance within block of interest i (S151) and sets the darkening coefficient of block of interest i as darkening coefficient Cmi (S152). Steps S151 and S152 are similar to steps S51*a* and S52*a* illustrated in FIG. 5A, and thus descriptions thereof will be omitted.

Next, controller 31 calculates the virtual luminance of block of interest i from the maximum luminance within block of interest i and darkening coefficient Cmi (S153). Specifically, controller 31 calculates the virtual luminance of block of interest i by multiplying the maximum luminance of the pixels within block of interest i by darkening coefficient Cmi. At this point, the correction of reducing the luminance has not been performed in block of interest i.

Referring back to FIG. 9, after the virtual luminance of block of interest i has been calculated in step S150, it is determined whether the calculation of the virtual luminance has been completed in all virtual blocks 60 (S160). If it is determined that controller 31 has finished calculating the virtual luminance in all of the plurality of virtual blocks 60 (Yes in S160), the process of calculating the virtual luminance is terminated, Meanwhile, if it is determined that controller 31 has not finished calculating the virtual luminance in all of the plurality of virtual blocks 60 (No in S160), the flow returns to step S140, and the processes in steps S140 and S150 are performed in remaining virtual blocks 60. There is no particular limitation on the order in which steps S140 and S150 are performed in the plurality of virtual blocks 60. In one example, however, steps S140 and S150 are performed in raster order.

Next, with reference to FIGS. 11 to 16, step S200 will be described.

Figure 11:
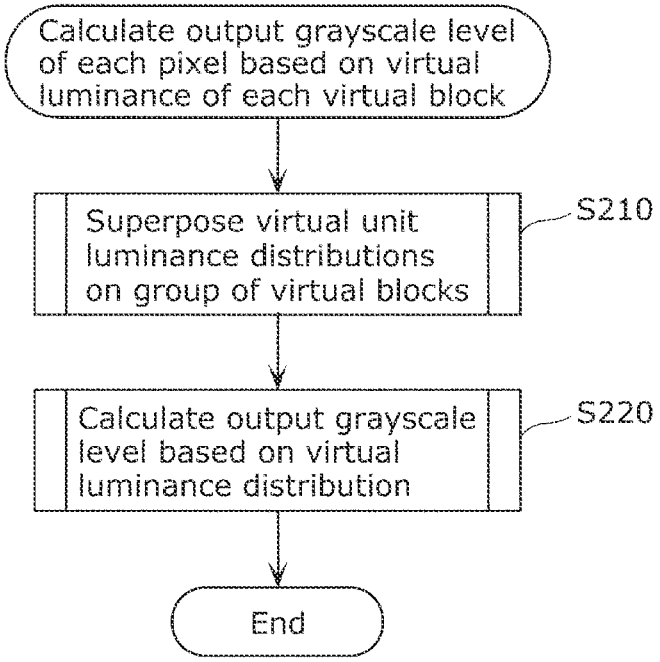
FIG. 11 is a flowchart illustrating a method of calculating an output grayscale level of each pixel referred to in FIG. 8.

FIG. 11 is a flowchart illustrating the method of calculating the output grayscale level of each pixel referred to in FIG. 8 (S200).

As illustrated in FIG. 11, controller 31 superposes virtual unit luminance distributions onto the plurality of virtual blocks 60 (a group of virtual blocks) (S210) and calculates the output grayscale level (i.e., the second luminance) based on a superposed virtual luminance distribution (S220). In step S210, controller 31 superposes the luminance distributions of the plurality of virtual luminances calculated in the process performed for respective virtual blocks 60 and creates one luminance distribution for one image. In addition, in step S220, controller 31 calculates the luminance to be held after the luminance correction (an example of the second luminance) based on the one luminance distribution and the luminance of each pixel held before the luminance correction (an example of the first luminance). Step S220 is an example of the second sub-step. The first and second sub-steps (S210 and S220) are included in the luminance correcting step.

First, with reference to FIGS. 12 and 13, step S210 will be described.

Figure 12:
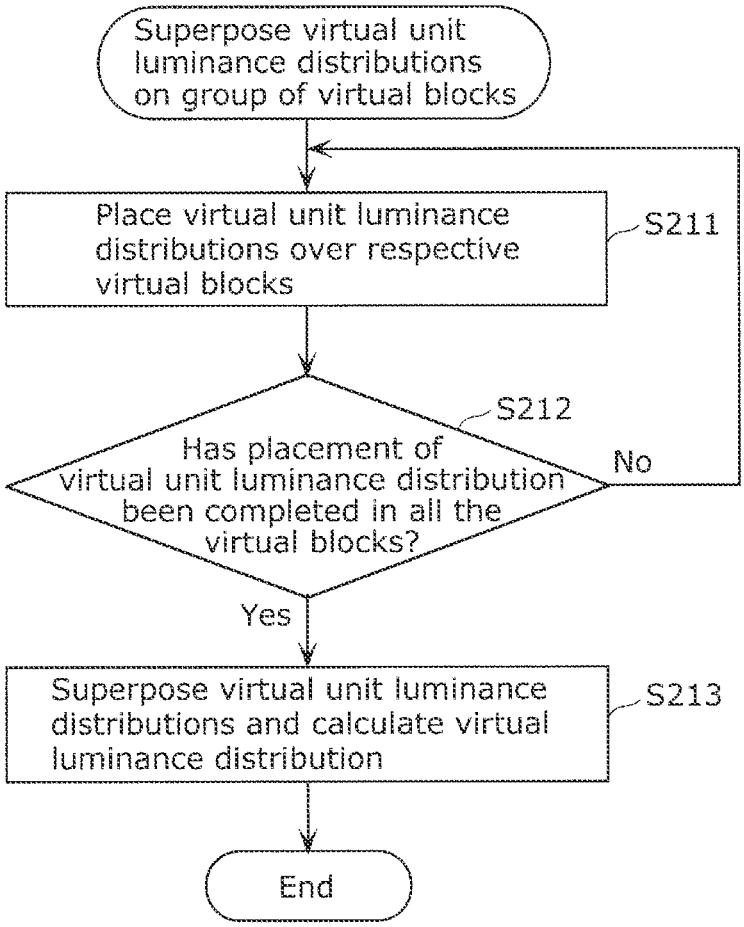
FIG. 12 is a flowchart illustrating a method of superposing virtual unit luminance distributions referred to in FIG. 11.

FIG. 12 is a flowchart illustrating a method of superposing the virtual unit luminance distributions referred to in FIG. 11 (S210), The process illustrated in FIG. 12 is performed in each block 60. FIG. 13 schematically illustrates the method of superposing the virtual unit luminance distributions referred to in FIG. 11.

Figure 13:
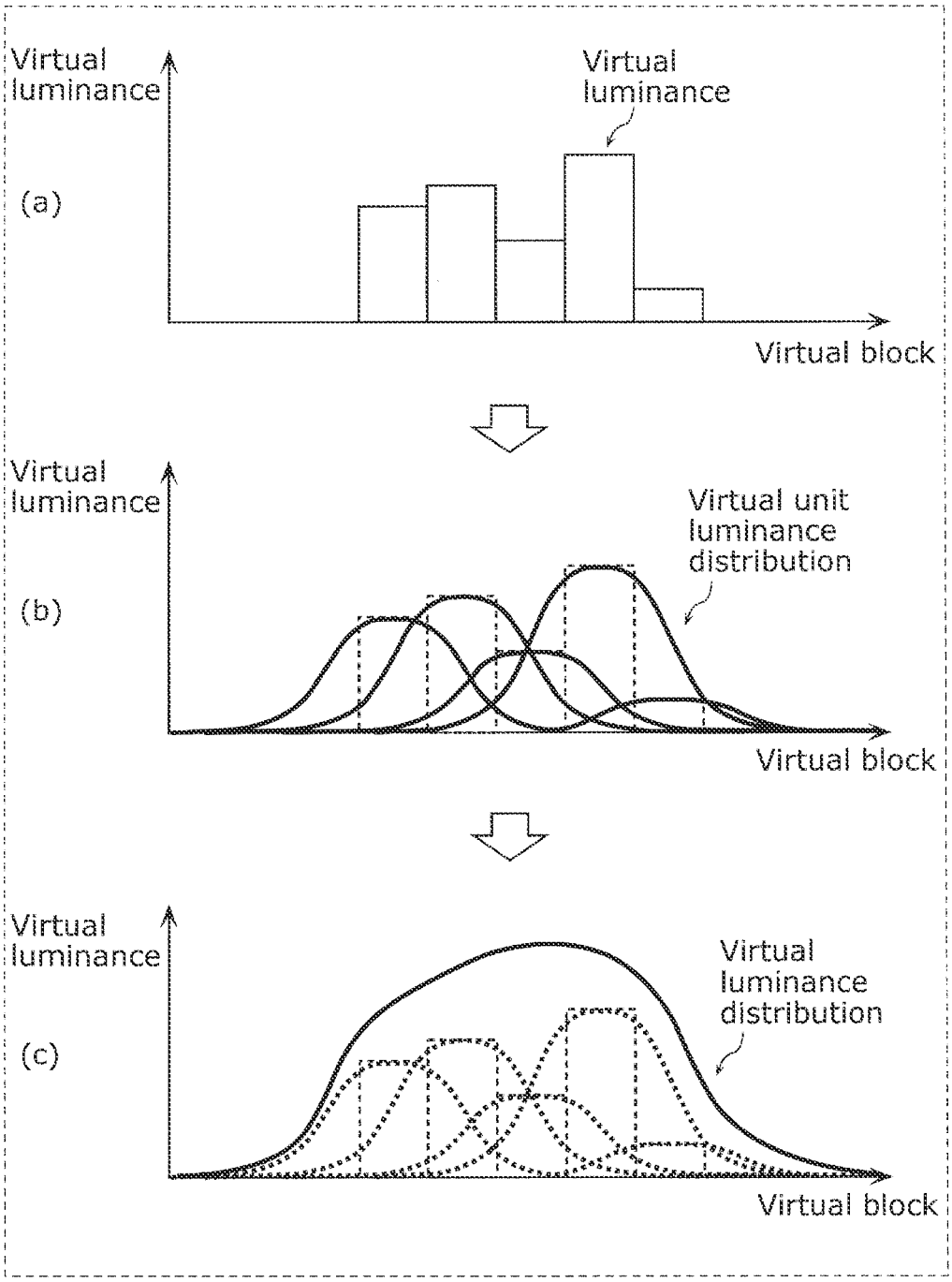
FIG. 13 schematically illustrates the method of superposing the virtual unit luminance distributions referred to in FIG. 11.

In FIG. 13, (a) illustrates a graph of the virtual luminance calculated for each virtual block 60, and this graph corresponds to a state held after the process in step S100 has been completed. Since one virtual luminance is set for each virtual block 60, each virtual block 60 is indicated by one virtual luminance. In (a) in FIG. 13, the virtual luminances of five virtual blocks 60 are illustrated.

As illustrated in FIG. 12, a virtual unit luminance distribution is placed over each virtual block 60 (S211). A virtual unit luminance distribution is a luminance distribution set for each of a plurality of virtual luminances. In other words, in step S211, a luminance distribution corresponding to a given virtual luminance is placed on a graph (a canvas for calculating the virtual luminance distribution) in each of the plurality of virtual luminances. A virtual unit luminance distribution is calculated based on the virtual luminance and the luminance distribution. The luminance distribution is determined through the cosine fourth law or the Gaussian distribution, for example, and is stored in advance in storage 32. Next, controller 31 determines whether the placement of a virtual unit luminance distribution has been completed in all virtual blocks 60 (S212). If controller 31 has determined that the placement of a virtual unit luminance distribution has been completed in all of the plurality of virtual blocks 60 (Yes in S212), controller 31 superposes the placed plurality of virtual unit luminance distributions and calculates a virtual luminance distribution (S213). In step S213, one virtual luminance distribution is calculated for one image. In step S213, with the virtual luminance of one virtual block 60 regarded as a first virtual luminance, controller 31 adds the contribution of the first virtual luminance (the influence of the first virtual luminance on the luminance distribution) to the luminance of virtual block 60 neighboring stated one virtual block 60 to the virtual luminance of stated neighboring virtual block 60 (an example of a second virtual luminance).

Meanwhile, if controller 31 has determined that the placement of a virtual unit luminance distribution has not been completed in all of the plurality of virtual blocks 60 (No in S212), the flow returns to step S211, and the process in step S211 is performed in remaining virtual blocks 60.

Herein, the placed virtual unit luminance distribution may be superposed successively on the canvas in each instance of step S211. In this case, this process is terminated when the result of Yes is obtained in S212.

In FIG. 13, (b) illustrates a state in which the virtual unit luminance distributions (the curves in (b) in FIG. 13) for respective virtual blocks 60 are placed. In the example illustrated in (b) in FIG. 13, five virtual unit luminance distributions are placed. As can be seen in (b) in FIG. 13, the virtual unit luminance distribution of each virtual block 60 extends over other virtual blocks 60. In other words, it can be seen that the virtual unit luminance distribution of each virtual block 60 has an influence on the brightness of other virtual blocks 60, In this example, each virtual unit luminance distribution is placed with an assumption that the pixel having the virtual luminance (i.e., the maximum luminance within virtual block 60) is located at substantially the center of that virtual block 60, However, such a pixel does not necessarily be located at substantially the center of virtual block 60, For example, the center of gravity of a three-dimensional body with the image of interest in given virtual block 60 serving as the base and with the luminance of each pixel plotted in the heightwise direction may be obtained, and the position obtained by projecting the position of the center of gravity onto the base may serve as the center of the virtual luminance.

In FIG. 13, (c) illustrates an example in which the virtual unit luminance distributions illustrated in (b) in FIG. 13 are superposed to calculate one virtual luminance distribution. Thus, one luminance distribution that takes the mutual influence of the plurality of virtual blocks 60 into consideration is created. In (a) in FIG. 13, the virtual luminance of virtual block 60 located in the middle among five virtual blocks 60 is lower than the virtual luminances of neighboring virtual blocks 60. Meanwhile, in (c) in FIG. 13, the virtual luminance of this virtual block 60 in the middle is higher than the virtual luminances of neighboring virtual blocks 60. This happens because of the influence of the luminance distributions of the virtual luminances of neighboring virtual blocks 60. Thus, virtual block 60 located in the middle among five virtual blocks 60 looks bright to the viewer, Therefore, controller 31 corrects the luminance of each pixel such that the amount of darkening of the luminance of the pixels composing this virtual block 60 in the middle is small.

In addition, as illustrated in (c) in FIG. 13, the virtual luminance distribution can assume a plurality of virtual luminance values within one virtual block 60. In other words, the virtual luminance distribution is set in each of the pixels composing one virtual block 60.

In the example described above, the virtual luminance is calculated by multiplying the maximum luminance of the pixels within virtual block 60 by the darkening coefficient, but this is not a limiting example. For example, the virtual luminance may be calculated by multiplying the mean luminance of the luminances of the pixels within virtual block 60 by the darkening coefficient or by multiplying the median luminance (the median value of the luminances of the pixels within virtual block 60) by the darkening coefficient. The luminance that is multiplied by the darkening coefficient to calculate the virtual luminance is an example of a second representative luminance. In the present embodiment, the maximum luminance of the pixels within virtual block 60 is the second representative luminance. The second representative luminance is determined for each of plurality of virtual blocks 60.

Next, with reference to FIGS. 14 and 15, step S220 will be described.

Figure 14:
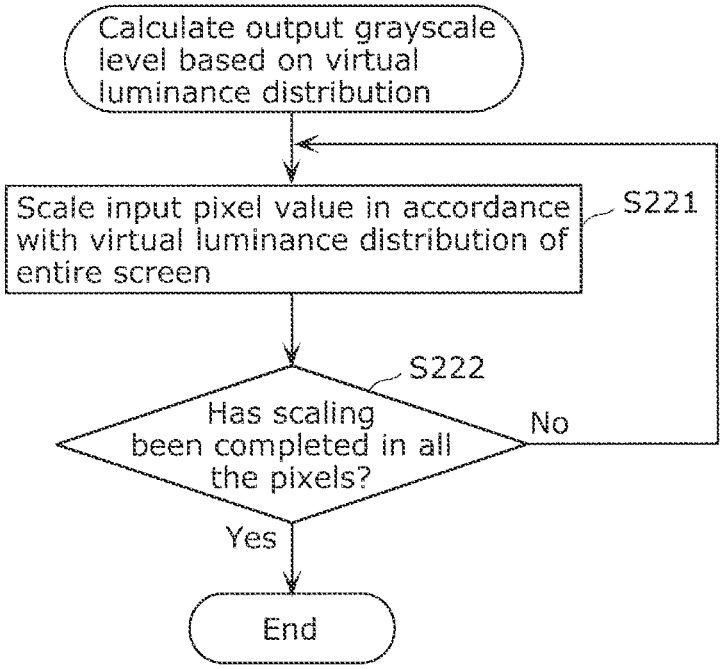
FIG. 14 is a flowchart illustrating a method of calculating the output grayscale level referred to in FIG. 11.

FIG. 14 is a flowchart illustrating a method of calculating the output grayscale level referred to in FIG. 11. The process illustrated in FIG. 14 is performed in units of pixels, FIG. 15 schematically illustrates the method of calculating the output grayscale level referred to in FIG. 11.

As illustrated in FIG. 14, controller 31 scales an input pixel value of an input image in accordance with the virtual luminance distribution of the entire screen calculated in step S210 (S221). In other words, controller 31 performs the correction of reducing the luminance (the pixel value) of the input image in accordance with the virtual luminance distribution. Specifically, controller 31 performs the correction of reducing the luminance of a given pixel in the input image for each of the pixels. Then, controller 31 determines whether the process in step S211 has been completed in all the pixels (S222). If controller 31 has determined that the input pixel value has been corrected in all of the plurality of pixels (Yes in S222), the process of calculating the output grayscale level based on the virtual luminance distribution is terminated, Meanwhile, if controller 31 has determined that the input pixel value has not been corrected in all of the plurality of pixels (No in S222), the flow returns to step S221, and the process of step S222 is performed in the remaining pixels. There is no particular limitation on the order in which step S221 is performed among the plurality of pixels.

Figure 15:
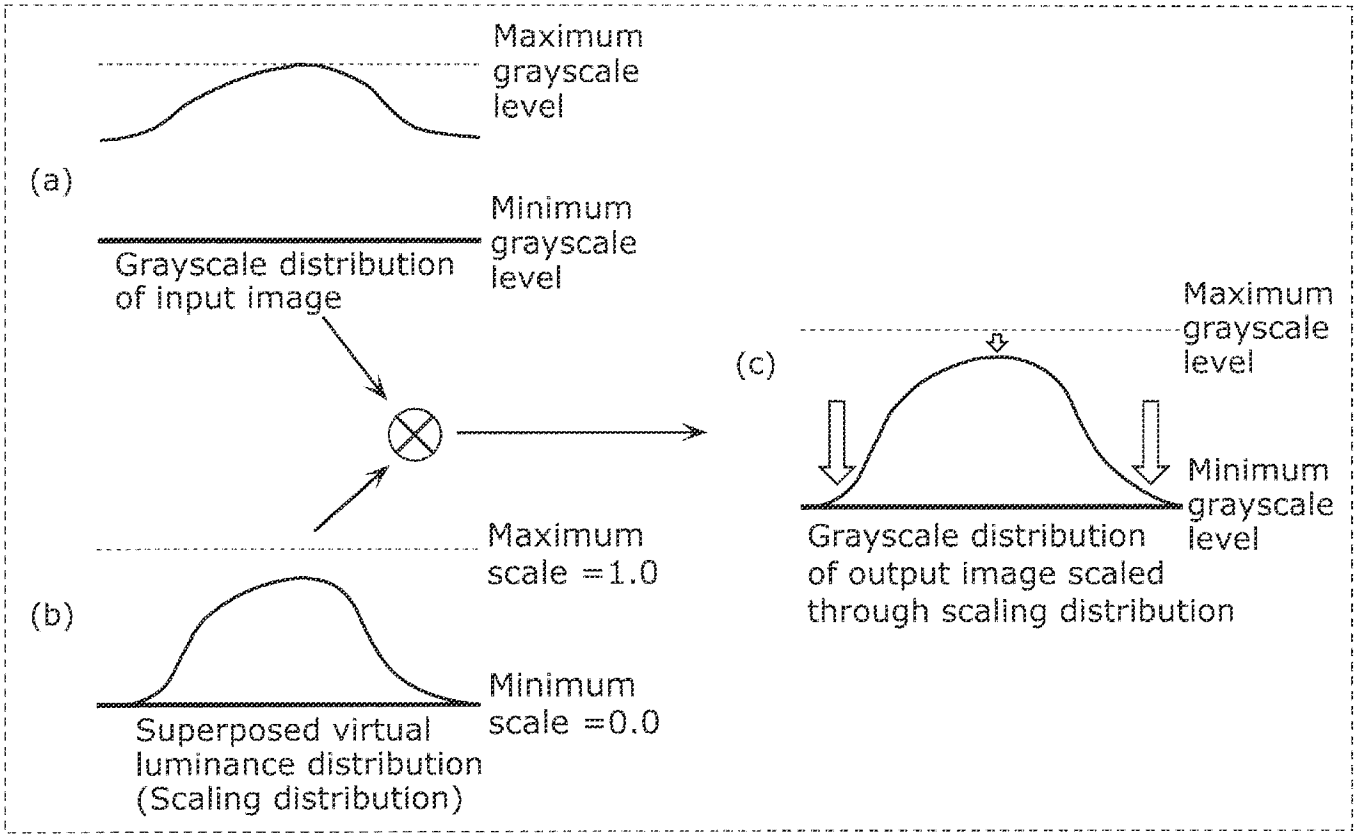
FIG. 15 schematically illustrates the method of calculating the output grayscale level referred to in FIG. 11.

In FIG. 15, (a) illustrates a grayscale distribution (a luminance distribution) of an input image. In (a) in FIG. 15, the vertical axis indicates the grayscale value (the luminance), and the horizontal axis indicates the pixels. Indicated in (a) in FIG. 15 is the pixel value (the luminance) held before the luminance correction, and this pixel value is an example of the first luminance.

In FIG. 15, (b) illustrates the superposed virtual luminance distribution (the scaling distribution) calculated in step S210. In (b) in FIG. 15, the vertical axis indicates the darkening coefficient, and the horizontal axis indicates the pixels. The virtual luminance distribution is composed of numerical values higher than or equal to zero and lower than or equal to one. The virtual luminance distribution illustrated in (b) in FIG. 15 is calculated by normalizing the virtual luminance distribution illustrated in (c) in FIG. 13 such that the maximum value of the virtual luminance distribution is lower than or equal to one. In addition, the virtual luminance distribution makes it possible to calculate the darkening coefficient for each of the pixels composing the plurality of virtual blocks 60.

In FIG. 15, (c) illustrates the grayscale distribution of an output image scaled in accordance with the scaling distribution illustrated in (b) in FIG. 15. In (c) in FIG. 15, the vertical axis indicates the grayscale value (the luminance), and the horizontal axis indicates the pixels. In FIG. 15, (c) illustrates a result obtained by correcting the grayscale distribution of the input image illustrated in (a) in FIG. 15 in accordance with the scaling distribution illustrated in (b) in FIG. 15. Indicated in (c) in FIG. 15 is an example of the second luminance obtained by correcting the first luminance in accordance with the virtual luminance distribution.

As illustrated in (c) in FIG. 15, in a pixel having a high value in the virtual luminance distribution, the amount of reduction in the pixel value of the input image (the amount of darkening of the luminance) is small. Meanwhile, in a pixel having a low value in the virtual luminance distribution, the amount of reduction in the pixel value of the input image is large (see the arrows indicated in (c) in FIG. 15).

The output grayscale distribution illustrated in (c) in FIG. 15 is calculated by, for each of the pixels, multiplying the pixel value of the input image in a given pixel by the darkening coefficient calculated from the scaling distribution. In other words, the darkening coefficient differs in different pixels even if these pixels all compose one virtual block 60.

In the foregoing example, the first luminance is corrected in consideration of the luminance distribution of the virtual luminances, but this is not a limiting example. For example, controller 31 may correct the first luminance in accordance with the distribution of the virtual luminances (see (a) in FIG. 13). Furthermore, the lowest luminance ensuring process illustrated in FIG. 3 may be performed after step S220.

Now, with reference to FIG. 16, another example of the virtual unit luminance distribution placed in step S211 will be described.

Figure 16:
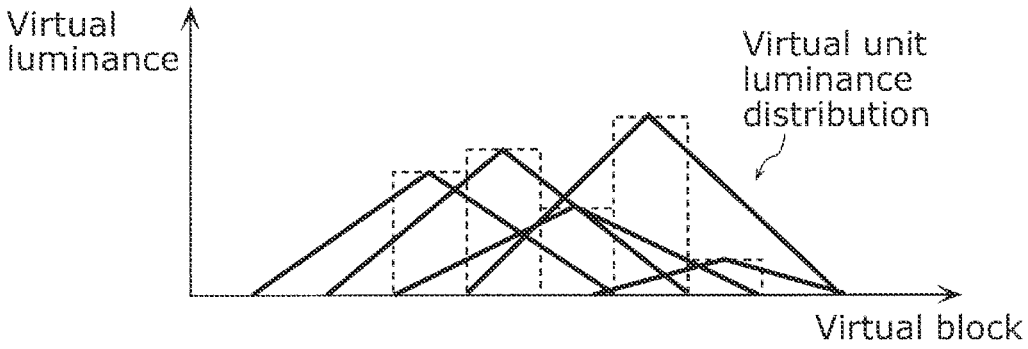
FIG. 16 schematically illustrates another example of the method of superposing the virtual unit luminance distributions referred to in FIG. 11.

FIG. 16 schematically illustrates another example of the method of superposing the virtual unit luminance distributions referred to in FIG. 11.

As illustrated in FIG. 16, the virtual unit luminance distributions may each be formed linearly with respect to the virtual luminance of each virtual block 60. This makes it possible to reduce the processing load of controller 31 as compared to the case where the virtual unit luminance distributions each follow a curve.

[2-2. Advantageous Effects and Others]

According to the luminance determining method illustrated in FIG. 8 and so on, the correction of reducing the luminance can be performed in consideration of the mutual influence of the plurality of virtual blocks 60. Furthermore, since the darkening coefficient is set for each pixel, the correction is less noticeable to the viewer, and the lifetime of display device 40 can be extended.

Other Embodiments

Thus far, the luminance determining method, the luminance determining device, and the video display apparatus according to one or more aspects of the present disclosure have been described based on the foregoing embodiments, but the present disclosure is not limited to the foregoing embodiments. Unless departing from the spirit of the present disclosure, an embodiment obtained by making various modifications that are conceivable by a person skilled in the art to the present embodiments or an embodiment obtained by combining the constituent elements of different embodiments may also be included within the scope of one or more aspects of the present disclosure.

For example, in the examples described in the foregoing embodiments, the luminance determining device counts the number of pixels with the use of one threshold (e.g., luminance Tb) if the second human vision characteristic is taken into consideration. Alternatively, the luminance determining device may count the number of pixels with the use of two or more thresholds. For example, the luminance determining device may calculate the correction coefficient (the darkening coefficient) in a given block with the use of two thresholds including luminances Tb and Tc and thus based on the number of pixels having a luminance higher than or equal to luminance Tb, the number of pixels having a luminance higher than or equal to luminance Tc and lower than luminance Tb, and the number of pixel having a luminance lower than luminance Tc. This makes it possible to perform a finer luminance correction.

In the examples described in the foregoing embodiments, the controller calculates the darkening coefficient through a function based on the maximum luminance and the mean luminance, but this is not a limiting example. The storage may hold a lookup table associating the luminance difference between the maximum luminance and the mean luminance with the darkening coefficient, and the controller may calculate the darkening coefficient based on the luminance difference and the lookup table.

In the foregoing embodiments, the luminance serves as an index for the control. Alternatively, the index for the control may be, for example, the lightness indicating the brightness. For example, this is because the luminance and the lightness, which is indicated by the so-called RGB value (the R value, the G value, and the B value) have the following relationship.

$$\text{Luminance}=0.299\times R+0.587\times G+0.114\times B \qquad \text{(Expression 4)}$$

As can be seen from Expression 4, the contribution of G (Green) to the luminance is high. Therefore, G in particular, that is, the lightness of Green may be used as an index for the control. "R" in Expression 4 represents the R value, "G" represent the G value, and "B" represents the B value.

A part of the whole of the constituent elements included in the luminance determining device and the video display apparatus (also referred to below as the luminance determining device and so on) according to the foregoing embodiments may be constituted by a single system large scale integration (LSI).

A system LSI is an ultra-multifunctional LSI manufactured by integrating a plurality of components on a single chip, and is, in particular, a computer system including a microprocessor, a read only memory (ROM), a random access memory (RAM), and so on. The ROM stores a computer program. The microprocessor operates in accordance with the computer program, and thus the system LSI implements its functions.

Although a system LSI is illustrated above, depending on the difference in the degree of integration, it may also be called an IC, an LSI, a super LSI, or an ultra LSI. The technique for circuit integration is not limited to an LSI, and an integrated circuit may be implemented by a dedicated circuit or a general-purpose processor. A field programmable gate array (FPGA) that can be programmed after an LSI is manufactured or a reconfigurable processor in which the connection or the setting of the circuit cells within the LSI can be reconfigured may also be used.

Furthermore, when a technique for circuit integration that replaces an LSI appears through the advancement in the semiconductor technology or through a derived different technique, the functional blocks may be integrated with the use of such a different technique. An application of biotechnology, for example, is a possibility.

The constituent elements included in the luminance determining device and so on according to the foregoing embodiments may be distributed among a plurality of devices connected via a communication network.

One aspect of the present disclosure does not need to be the luminance determining device and so on described above and may also be a luminance determining method that includes the characteristic constituent elements included in the luminance determining device and so on in the form of steps. In addition, one aspect of the present disclosure may be a computer program that causes a computer to execute the characteristic steps included in the luminance determining method. Furthermore, one aspect of the present disclosure may be a non-transitory computer-readable recording medium that has such a computer program recorded thereon.

In the foregoing embodiments, the constituent elements may each be implemented by dedicated hardware or may each be implemented through execution of a software program suitable for the corresponding constituent element. Each of the constituent elements may be implemented as a program executing unit, such as a central processing unit (CPU) or a processor, reads out a software program recorded on a recording medium, such as a hard disk or a semiconductor memory, and executes the software program.

In addition, the order of the plurality of processes described in the foregoing embodiments is an example. The order of the plurality of processes may be modified, or the plurality of processes may be executed in parallel.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The luminance determining method according to the present disclosure can be applied to a method of correcting the luminance of each pixel in a display device that includes self emitting elements.

The invention claimed is:

1. A luminance determining method of determining a luminance of each pixel in a display device that includes a self emitting element, the luminance determining method comprising:

dividing one image into a plurality of blocks that do not overlap each other; and performing a luminance correction to correct, in each of the plurality of blocks, a luminance of each pixel by reducing the luminance in the plurality of blocks through a correction method determined for each of the plurality of blocks, wherein:

when a luminance of each pixel input before the luminance correction is defined as a first luminance and a luminance of each pixel that has been subjected to the luminance correction is defined as a second luminance, the correction method includes bringing the second luminance to a luminance threshold when the second luminance has fallen below the luminance threshold.

2. The luminance determining method according to claim 1, wherein the correction method corrects the first luminance to the second luminance by reducing, in each of the plurality of blocks, a luminance of each pixel in one block among the plurality of blocks by an amount according to a level of a bright luminance relative to a first representative luminance, wherein the higher the level is, the smaller the amount is, the first representative luminance being a luminance of a pixel within the one block, the bright luminance being a luminance of another pixel having a luminance higher than the first representative luminance.

3. The luminance determining method according to claim 2, wherein when the first representative luminance is defined as a mean value of first luminances of the pixels in the one block, and the bright luminance is defined as a maximum value of the first luminances of the pixels in the one block, the correction method corrects, in each of the plurality of blocks, the first luminance of each pixel to the second luminance based on the mean value in the one block among the plurality of blocks and the maximum value in the one block.

4. The luminance determining method according to claim 3, wherein the correction method corrects the first luminance of each pixel to the second luminance based on a difference between the mean value and the maximum value.

5. The luminance determining method according to claim 4, wherein the correction method corrects the first luminance to reduce a luminance difference between the first luminance and the second luminance by an amount according to the difference between the mean value and the maximum value, wherein the greater the difference between the mean value and the maximum value is, the more the amount is.

6. The luminance determining method according to claim 1, wherein the luminance correction includes:

setting, in each of the plurality of blocks, one virtual luminance based on a second representative luminance that is based on a luminance of a pixel in one block among the plurality of blocks and a darkening coefficient that is based on luminances of pixels in the one block; and correcting the first luminance of each pixel to the second luminance based on the virtual luminance set for each of the plurality of blocks.

7. The luminance determining method according to claim 6, wherein in the correcting of the first luminance, a contribution of a first virtual luminance to a neighboring block in the one block is added to a second virtual luminance of the neighboring block, the contribution being based on a luminance distribution of the first virtual luminance in the one block among the plurality of blocks.

8. The luminance determining method according to claim 6, wherein the darkening coefficient is calculated based on a difference between a mean value of a luminance of each pixel in the one block and a maximum value of a luminance of each pixel in the one block.

9. The luminance determining method according to claim 6, wherein the second representative luminance is a maximum value of a luminance of each pixel in the one block.

10. The luminance determining method according to claim 1, wherein the luminance is not corrected after the luminance correction.

11. The luminance determining method according to claim 1, wherein the plurality of blocks have an identical shape.

12. A luminance determining method of determining a luminance of each pixel in a display device that includes a self emitting element, the luminance determining method comprising:

dividing one image into a plurality of blocks that do not overlap each other; and performing a luminance correction to correct, in each of the plurality of blocks, a luminance of each pixel by reducing the luminance in the plurality of blocks through a correction method determined for each of the plurality of blocks, wherein:

when a luminance of each pixel input before the luminance correction is defined as a first luminance and a luminance of each pixel that has been subjected to the luminance correction is defined as a second luminance, the correction method corrects, in each of the plurality of blocks, the first luminance of each pixel in a given block to the second luminance based on a total number of pixels, within the given block, that have a first luminance higher than a first luminance threshold.

13. The luminance determining method according to claim 12, wherein the correction method corrects the first luminance to reduce a difference between the first luminance and the second luminance by an amount according to the total number of pixels, wherein the larger the total number of pixels is, the more the amount is.

14. A luminance determining method of determining a luminance of each pixel in a display device that includes a self emitting element, the luminance determining method comprising:

dividing one image into a plurality of blocks that do not overlap each other; and performing a luminance correction to correct, in each of the plurality of blocks, a luminance of each pixel by reducing the luminance in the plurality of blocks through a correction method determined for each of the plurality of blocks, wherein:

when a luminance of each pixel input before the luminance correction is defined as a first luminance and a luminance of each pixel that has been subjected to the luminance correction is defined as a second luminance, the luminance correction includes:

obtaining a first coefficient based on a difference between a mean value of first luminances of the pixels in one block among the plurality of blocks and a maximum value of the first luminances of the pixels in the one block;

obtaining a second coefficient based on a number of pixels, within the one block, that have the first luminance higher than a first luminance threshold; and calculating the second luminance by correcting the first luminance of each pixel in the one block based on the first coefficient and the second coefficient.

15. The luminance determining method according to claim 14, wherein when the first coefficient is defined as Cmi, the second coefficient is defined as Cbi, a value higher than or equal to zero and lower than or equal to one is defined as $\alpha$, and a third coefficient is defined as $Ci=\alpha\times Cmi+(1-\alpha)\times Cbi$, the calculating calculates the second luminance by correcting the first luminance of each pixel in the one block based on the third coefficient.

16. A luminance determining device that determines a luminance of each pixel in a display device that includes a self emitting element, the luminance determining device comprising:

a controller that divides one image into a plurality of blocks that do not overlap each other and performs a luminance correction to correct, in each of the plurality of blocks, a luminance of each pixel by reducing the luminance in the plurality of blocks through a correction method determined for each of the plurality of blocks, wherein:

when a luminance of each pixel input before the luminance correction is defined as a first luminance and a luminance of each pixel that has been subjected to the luminance correction is defined as a second luminance, the controller brings the second luminance to a luminance threshold when the second luminance has fallen below the luminance threshold.

17. A video display apparatus, comprising:

the luminance determining device according to claim 16; and a display device that displays an image having a luminance determined by the luminance determining device and that includes a self emitting element.

* * * * *